US010760814B2

(12) United States Patent
Popli et al.

(10) Patent No.: US 10,760,814 B2
(45) Date of Patent: Sep. 1, 2020

(54) VARIABLE-CAPACITY COMPRESSOR CONTROLLER WITH TWO-WIRE CONFIGURATION

(71) Applicant: Emerson Climate Technologies, Inc., Sidney, OH (US)

(72) Inventors: Sahil Popli, Troy, OH (US); Vikram Balasaheb Gholap, Pune (IN); Chetan Avinash Sowani, Pune (IN); Tanmay Hemant Deshpande, Nashik (IN); Edward J. Trudeau, Jr., Covington, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 420 days.

(21) Appl. No.: 15/602,328

(22) Filed: May 23, 2017

(65) Prior Publication Data

US 2017/0343230 A1 Nov. 30, 2017

(30) Foreign Application Priority Data

May 27, 2016 (IN) ..... 201621018358

(51) Int. Cl.
*F24F 11/86* (2018.01)
*F24F 11/83* (2018.01)
(Continued)

(52) U.S. Cl.
CPC ..... *F24F 11/83* (2018.01); *F24F 11/30* (2018.01); *F24F 11/62* (2018.01); *F24F 11/64* (2018.01);
(Continued)

(58) Field of Classification Search
CPC .. F24F 11/83; F24F 11/62; F24F 11/85; F24F 11/64; F24F 11/30; F24F 2140/50;
(Continued)

(56) References Cited

U.S. PATENT DOCUMENTS 4,228,846 A 10/1980 Smorol
4,257,238 A 3/1981 Kountz et al.
(Continued)

FOREIGN PATENT DOCUMENTS

AU 744608 B2 2/2002
CN 1239211 A 12/1999
(Continued)

OTHER PUBLICATIONS

U.S. Appl. No. 15/457,418, filed Mar. 13, 2017, Edward J. Trudeau et al.
(Continued)

*Primary Examiner* — Suresh Suryawanshi
(74) *Attorney, Agent, or Firm* — Harness, Dickey & Pierce, P.L.C.

(57) ABSTRACT

A system includes a converter and a controller to control a compressor and operates without receiving power supply from a thermostat. The converter receives a demand signal from the thermostat that is used to power the controller and charge a capacitor. When the thermostat de-asserts the demand signal, the charged capacitor powers the controller, which saves system parameters in a nonvolatile memory and enters a power save mode. The life of the nonvolatile memory is extended by alternately storing the system parameters in different memory locations. The system normalizes outdoor ambient temperature (OAT) during a demand cycle. The system determines OAT slope, which is used to select durations to operate the compressor at different capacities, by performing time based calculations during a demand cycle, demand cycle based calculations at the start of a demand cycle, or time and demand cycle based calculations during a demand cycle.

30 Claims, 13 Drawing Sheets

(51) Int. Cl.

| | |
|---|---|
| ***F24F 11/85*** | (2018.01) |
| ***F24F 11/64*** | (2018.01) |
| ***F24F 11/30*** | (2018.01) |
| ***F24F 11/62*** | (2018.01) |
| ***F25B 49/02*** | (2006.01) |
| *F24F 110/12* | (2018.01) |
| *F24F 11/63* | (2018.01) |
| *F24F 11/61* | (2018.01) |
| *F24F 110/10* | (2018.01) |
| *F24F 140/50* | (2018.01) |
| *F25B 13/00* | (2006.01) |

(52) U.S. Cl.
CPC ..... *F24F 11/85* (2018.01); *F25B 49/022* (2013.01); *F24F 11/61* (2018.01); *F24F 11/63* (2018.01); *F24F 2110/10* (2018.01); *F24F 2110/12* (2018.01); *F24F 2140/50* (2018.01); *F25B 13/00* (2013.01); *F25B 2500/19* (2013.01); *F25B 2600/01* (2013.01); *F25B 2600/0252* (2013.01); *F25B 2700/2106* (2013.01)

(58) Field of Classification Search
CPC ..... F24F 11/63; F24F 11/61; F24F 2110/10; F24F 2110/12; F24F 11/0086; F25B 49/022; F25B 2600/01; F25B 2500/19; F25B 13/00; F25B 2600/0252; F25B 2700/2106
USPC ..... 700/276
See application file for complete search history.

(56) References Cited

U.S. PATENT DOCUMENTS

| | | | | |
|---|---|---|---|---|
| 4,431,134 | A * | 2/1984 | Hendricks | G06F 1/30 236/46 R |
| 4,685,615 | A * | 8/1987 | Hart | G05D 23/1902 165/11.1 |
| 5,062,276 | A | 11/1991 | Dudley | |
| 5,129,234 | A | 7/1992 | Alford | |
| 5,305,822 | A | 4/1994 | Kogetsu et al. | |
| 5,381,669 | A | 1/1995 | Bahel et al. | |
| 5,385,453 | A | 1/1995 | Fogt et al. | |
| 6,213,731 | B1 | 4/2001 | Doepker et al. | |
| 6,293,116 | B1 | 9/2001 | Forrest et al. | |
| 6,318,101 | B1 | 11/2001 | Pham et al. | |
| 6,450,409 | B1 | 9/2002 | Rowlette et al. | |
| 6,578,373 | B1 | 6/2003 | Barbier | |
| 6,679,072 | B2 | 1/2004 | Pham et al. | |
| 7,752,854 | B2 | 7/2010 | Singh et al. | |
| 7,845,179 | B2 | 12/2010 | Singh et al. | |
| 8,011,199 | B1 | 9/2011 | Chen et al. | |
| 8,209,073 | B2 | 6/2012 | Wijaya et al. | |
| 8,418,483 | B2 | 4/2013 | McSweeney et al. | |
| 8,459,053 | B2 | 6/2013 | Pham et al. | |
| 8,485,789 | B2 | 7/2013 | Gu et al. | |
| 8,538,587 | B2 | 9/2013 | Hess et al. | |
| 8,585,382 | B2 | 11/2013 | Akei et al. | |
| 8,616,014 | B2 | 12/2013 | Stover et al. | |
| 8,863,536 | B1 | 10/2014 | Perry et al. | |
| 9,194,393 | B2 | 11/2015 | Pham | |
| 9,562,710 | B2 | 2/2017 | Pham et al. | |
| 9,709,311 | B2 | 7/2017 | Popli et al. | |
| 10,018,392 | B2 | 7/2018 | Guo | |
| 10,371,426 | B2 | 8/2019 | Pham et al. | |
| 10,436,490 | B2 | 10/2019 | Pham et al. | |
| 2003/0033823 | A1 | 2/2003 | Pham et al. | |
| 2003/0156946 | A1 | 8/2003 | Tolbert | |
| 2005/0155369 | A1 | 7/2005 | Ootori et al. | |
| 2005/0257538 | A1 | 11/2005 | Hwang et al. | |
| 2006/0032253 | A1 | 2/2006 | Lee et al. | |
| 2006/0037332 | A1 | 2/2006 | Hwang et al. | |
| 2006/0156749 | A1 | 7/2006 | Lee et al. | |
| 2006/0260334 | A1 | 11/2006 | Carey et al. | |
| 2006/0280627 | A1 | 12/2006 | Jayanth | |
| 2007/0012052 | A1 | 1/2007 | Butler et al. | |
| 2007/0032909 | A1 | 2/2007 | Tolbert et al. | |
| 2007/0079620 | A1 | 4/2007 | Lee | |
| 2007/0151267 | A1 | 7/2007 | Hatano et al. | |
| 2007/0267508 | A1 * | 11/2007 | Hoglund | G05D 23/1902 236/49.1 |
| 2008/0135635 | A1 | 6/2008 | Deng et al. | |
| 2008/0286118 | A1 | 11/2008 | Gu et al. | |
| 2009/0159716 | A1 | 6/2009 | Kim | |
| 2010/0064714 | A1 | 3/2010 | Tashiro | |
| 2010/0082162 | A1 | 4/2010 | Mundy et al. | |
| 2010/0107668 | A1 | 5/2010 | Voorhis et al. | |
| 2010/0179703 | A1 | 7/2010 | Singh et al. | |
| 2010/0218527 | A1 | 9/2010 | Kitagishi et al. | |
| 2010/0268397 | A1 | 10/2010 | Whitehurst et al. | |
| 2010/0275628 | A1 | 11/2010 | Moseley | |
| 2010/0314458 | A1 | 12/2010 | Votaw et al. | |
| 2011/0014890 | A1 | 1/2011 | Ajram et al. | |
| 2012/0090337 | A1 | 4/2012 | Chen et al. | |
| 2012/0185728 | A1 | 7/2012 | Guo et al. | |
| 2012/0297805 | A1 | 11/2012 | Kamada et al. | |
| 2012/0318007 | A1 | 12/2012 | Lukasse et al. | |
| 2013/0167571 | A1 | 7/2013 | Nakagawa | |
| 2014/0033746 | A1 | 2/2014 | McSweeney | |
| 2014/0262134 | A1 | 9/2014 | Arensmeier et al. | |
| 2015/0219356 | A1 | 8/2015 | Ito et al. | |
| 2015/0323212 | A1 * | 11/2015 | Warren | G05D 23/1902 236/1 C |
| 2016/0313039 | A1 | 10/2016 | Popli et al. | |
| 2016/0313040 | A1 | 10/2016 | Trudeau et al. | |
| 2016/0313042 | A1 | 10/2016 | Popli et al. | |
| 2017/0268812 | A1 | 9/2017 | Trudeau et al. | |
| 2017/0343230 | A1 | 11/2017 | Popli et al. | |
| 2017/0350633 | A1 | 12/2017 | Popli et al. | |
| 2019/0170417 | A1 | 6/2019 | Popli et al. | |

FOREIGN PATENT DOCUMENTS

| | | | |
|---|---|---|---|
| CN | 1291702 | A | 4/2001 |
| CN | 1467441 | A | 1/2004 |
| CN | 1482408 | A | 3/2004 |
| CN | 1517624 | A | 8/2004 |
| CN | 1699865 | A | 11/2005 |
| CN | 1699869 | A | 11/2005 |
| CN | 1737440 | A | 2/2006 |
| CN | 1796879 | A | 7/2006 |
| CN | 1873352 | A | 12/2006 |
| CN | 1991173 | A | 7/2007 |
| CN | 101103201 | A | 1/2008 |
| CN | 101109553 | A | 1/2008 |
| CN | 101137873 | A | 3/2008 |
| CN | 101464022 | A | 6/2009 |
| CN | 101586866 | A | 11/2009 |
| CN | 101968249 | A | 2/2011 |
| CN | 103216910 | A | 7/2013 |
| EP | 1398576 | A2 | 3/2004 |
| EP | 1605214 | A2 | 12/2005 |
| EP | 1684025 | A1 | 7/2006 |
| EP | 2050958 | A1 | 4/2009 |
| EP | 2443403 | A1 | 4/2012 |
| EP | 2772699 | A1 | 9/2014 |
| JP | H03160261 | A | 7/1991 |
| JP | H09318140 | A | 12/1997 |
| JP | 2745836 | B2 | 4/1998 |
| KR | 100715999 | B1 | 5/2007 |
| KR | 20070071090 | A | 7/2007 |
| KR | 20080089967 | A | 10/2008 |
| KR | 20100059522 | A | 6/2010 |
| KR | 20130033847 | A | 4/2013 |
| WO | WO-9814739 | A1 | 4/1998 |
| WO | WO-2007130051 | A1 | 11/2007 |
| WO | WO-2009061301 | A1 | 5/2009 |
| WO | WO-2013149210 | A1 | 10/2013 |

(56) References Cited

FOREIGN PATENT DOCUMENTS

| | | | |
|---|---|---|---|
| WO | WO-2014017316 | A1 | 1/2014 |
| WO | WO-2015153766 | A1 | 10/2015 |

OTHER PUBLICATIONS

U.S. Appl. No. 15/651,942, filed Jul. 17, 2017, Sahil Popli et al.
U.S. Appl. No. 15/138,771, filed Apr. 26, 2016, Edward J. Trudeau et al.
U.S. Appl. No. 15/138,981, filed Apr. 26, 2016, Sahil Popli et al.
International Search Report regarding International Application No. PCT/US2016/029536, dated Sep. 12, 2016.
International Search Report regarding International Application No. PCT/US2016/029543, dated Aug. 9, 2016.
International Search Report regarding International Application No. PCT/US2016/029588, dated Aug. 9, 2016.
International Search Report regarding International Application No. PCT/US2017/022563, dated Jun. 26, 2017.
International Search Report regarding International Application No. PCT/US2016/029593, dated Aug. 10, 2016.
International Search Report regarding International Application No. PCT/US2017/034510, dated Aug. 28, 2017.
Notice of Allowance and Fees Due dated May 25, 2017.
Written Opinion of the International Searching Authority regarding International Application No. PCT/US2016/029536, dated Sep. 12, 2016.
Written Opinion of the International Searching Authority regarding International Application No. PCT/US2016/029543, dated Aug. 9, 2016.
Written Opinion of the International Searching Authority regarding International Application No. PCT/US2016/029588, dated Aug. 9, 2016.
Written Opinion of the International Searcing Authority regarding International Application No. PCT/US2016/029593, dated Aug. 10, 2016.
Written Opinion of the International Searching Authority regarding International Application No. PCT/US2017/022563, dated Jun. 26, 2017.
Written Opinion of the International Searching Authority regarding International Application No. PCT/US2017/034510, dated Aug. 28, 2017.
Non-Final Office Action regarding U.S. Appl. No. 15/138,771 dated Jun. 5, 2018.
Applicant-Initiated Interview Summary regarding U.S. Appl. No. 15/457,418 dated Oct. 2, 2018.
European Search Report regarding European Application No. 16787055.9, dated Mar. 27, 2019.
First Examination Report for Indian Application No. 201621018358 dated Mar. 27, 2019, 6 pages.
Notice of Allowance regarding U.S. Appl. No. 15/457,418 dated Feb. 7, 2019.
Notice of Allowance regarding U.S. Appl. No. 15/651,942 dated Aug. 16, 2018.
Final Office Action regarding U.S. Appl. No. 15/138,771 dated Apr. 18, 2019.
Notice of Allowance regarding U.S. Appl. No. 15/138,981, dated Jul. 2, 2018.
Notice of Allowance regarding U.S. Appl. No. 15/651,942 dated Jul. 9, 2018.
Office Action regarding U.S. Appl. No. 15/457,418, dated Jul. 26, 2018.
Corrected Notice of Allowability regarding U.S. Appl. No. 15/457,418 dated May 10, 2019.
Notice of Allowability and Applicant-Initiated Interview Summary regarding U.S. Appl. No. 15/457,418 dated Jun. 3, 2019.
Notice of Allowance regarding U.S. Appl. No. 15/138,771 dated Aug. 16, 2019.
Notice of Allowance regarding U.S. Appl. No. 15/138,771 dated Sep. 18, 2019.
Notice of Allowance regarding U.S. Appl. No. 15/457,418 dated May 1, 2019.
Notice of Allowance regarding U.S. Appl. No. 16/193,310 dated Aug. 14, 2019.
Notice of Allowance regarding U.S. Appl. No. 16/193,310 dated Jul. 8, 2019.
Office Action regarding Chinese Patent Application No. 201680030841.4, dated Jun. 24, 2019. Translation provided by Unitalen Attorneys at Law.
Office Action regarding Chinese Patent Application No. 201680030864.5, dated Aug. 5, 2019. Translation provided by Unitalen Attorneys at Law.
Office Action regarding Chinese Patent Application No. 201680031951.2, dated Jul. 3, 2019. Translation provided by Unitalen Attorneys at Law.
Office Action regarding Chinese Patent Application No. 201680032857.9, dated Jul. 3, 2019. Translation provided by Unitalen Attorneys at Law.
Extended European Search Report regarding European Patent Application No. 17803598.6, dated Dec. 16, 2019.
Search Report regarding European Patent Application No. 17767461.1, dated Oct. 22, 2019.
Office Action regarding Chinese Patent Application No. 201780017242.3, dated Jan. 3, 2020. Translation provided by Unitalen Attorneys at Law.

* cited by examiner

550

| OAT (°F) | Check OAT | Y1RT | OAT Slope + | OAT Slope - |
|---|---|---|---|---|
| | > 90 | 30 | If $T2_{n-1}$ > 5, $T1_n$= 5 s, Else $T1_n$ = 30 | If $T2_{n-1}$ > 5, $T1_n$= 5 s, Else $T1_n$ = 25 (30-5 or Y1RT-Tadj) |
| | | | Tadj = 0 | Tadj = 5 |
| | 85-90 | 30 | If $T2_{n-1}$ > 5, $T1_n$= 5 s, Else $T1_n$ = 50 (30+20) | If $T2_{n-1}$ > 5, $T1_n$= 5 s, Else $T1_n$ = 25 |
| | | | Tadj = 20 | Tadj = 5 |
| | 80-85 | 40 | If $T2_{n-1}$ > 5, $T1_n$= 5 m, Else $T1_n$ = 55 | If $T2_{n-1}$ > 5, $T1_n$= 5 s, Else $T1_n$ = 30 |
| | | | Tadj = 15 | Tadj = 10 |
| | 75-80 | 40 | If $T2_{n-1}$ > 10, $T1_n$= 10 m, Else $T1_n$ = 60 | If $T2_{n-1}$ > 10, $T1_n$= 5 s, Else $T1_n$ = 40 |
| | | | Tadj = 20 | Tadj = 0 |
| | 45-75 | 60 | T1=60 | |
| | 35-45 | 40 | If $T2_{n-1}$ > 5, $T1_n$= 5 s, Else $T1_n$ = 30 (Y1RT-Tadj) | If $T2_{n-1}$ > 5, $T1_n$= 5 s, Else $T1_n$ = 40 (Y1RT+Tadj) |
| | | | Tadj = 10 | Tadj = 0 |
| | 30-35 | 30 | If $T2_{n-1}$ > 5, $T1_n$= 5 s, Else $T1_n$ = 20 | If $T2_{n-1}$ > 5, $T1_n$= 5 s, Else $T1_n$ = 40 |
| | | | Tadj = 10 | Tadj = 10 |
| | < 30 | 20 | If $T2_{n-1}$ > 5, $T1_n$= 5 s, Else $T1_n$ = 15 | If $T2_{n-1}$ > 5, $T1_n$= 5 s, Else $T1_n$ = 20 |
| | | | Tadj = 5 | Tadj = 0 |

Runtimes in Minutes

FIG. 7

| OAT (°F) | Check OAT | Y1RT |
|---|---|---|
| | > 90 | 30 |
| | 85-90 | 30 |
| | 80-85 | 40 |
| | 75-80 | 40 |
| | 45-75 | 60 |
| | 35-45 | 40 |
| | 30-35 | 30 |
| | < 30 | 20 |

Runtimes in Minutes

VARIABLE-CAPACITY COMPRESSOR CONTROLLER WITH TWO-WIRE CONFIGURATION

CROSS-REFERENCE TO RELATED APPLICATIONS

This application claims the benefit of Indian Patent Application No. 201621018358, filed on May 27, 2016. The entire disclosure of the application referenced above is incorporated herein by reference.

FIELD

The present disclosure relates to a two-wire climate-control system including a variable-capacity compressor and methods for controlling the climate-control system.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, an indoor heat exchanger, an expansion device disposed between the indoor and outdoor heat exchangers, and a compressor circulating a working fluid (e.g., refrigerant or carbon dioxide) between the indoor and outdoor heat exchangers. Varying a capacity of the compressor can impact the energy-efficiency of the system and the speed with which the system is able to heat or cool a room or space.

SUMMARY

This section provides a general summary of the disclosure, and is not a comprehensive disclosure of its full scope or all of its features.

In one form, a climate control system comprises a converter and a controller. The converter is configured to receive a demand signal from a thermostat and to generate power based on the demand signal. The controller is configured to receive the power generated by the converter based on the demand signal and to control a compressor based on the demand signal received from the thermostat and the power received from the converter. The controller normalizes data obtained during a first predetermined time period in a demand cycle, the data indicating thermal load applied to a space conditioned by the compressor.

The controller selectively determines a slope of the data after a second predetermined time period in the demand cycle. The controller controls the compressor based on one or more of the normalized data and the slope of the data determined during the demand cycle.

In some configurations, the controller has access to the data during the demand cycle and for a third predetermined time period after the thermostat de-asserts the demand signal at an end of the demand cycle, the third predetermined time period being less than a time period between successive demand cycles. The controller receives power from the converter during the demand cycle and from a capacitor during the third predetermined time period, the capacitor being charged by the converter during the demand cycle.

In some configurations, the controller determines the slope of the data based on the normalized data from the demand cycle and based on an additional normalized data determined after the second predetermined time period in the demand cycle or determined in a prior demand cycle.

In some configurations, the climate control system further comprises a nonvolatile memory and a capacitor. The nonvolatile memory stores the normalized data from the demand cycle and the additional normalized data determined in the prior demand cycle. The capacitor receives power from the converter during each demand cycle and supplies the power to the nonvolatile memory at an end of each demand cycle.

In some configurations, the converter receives power from the demand signal.

In some configurations, the climate control system further comprises a capacitor to receive the power from the converter and to supply the power from the capacitor to the controller after the thermostat de-asserts the demand signal. The controller includes a nonvolatile memory. The controller detects when the power from the converter is unavailable after the thermostat de-asserts the demand signal. The controller receives the power from the capacitor after the thermostat de-asserts the demand signal. The controller stores one or more of the normalized data and the slope of the data in the nonvolatile memory based on the power received from the capacitor.

In some configurations, when the thermostat reasserts the demand signal, the controller reads the stored data from the nonvolatile memory and controls the compressor based on the read data.

In some configurations, after storing one or more of the normalized data and the slope of the data in the nonvolatile memory, the controller operates in a power save mode until the thermostat reasserts the demand signal.

In some configurations, the compressor is operable at a first capacity or a second capacity that is greater than the first capacity. The controller operates the compressor at the first capacity for the first predetermined time period when the demand signal is received.

In some configurations, the controller receives, during the first predetermined time period, the data including measured values of a parameter indicating the thermal load. The controller determines a normalized value of the parameter to generate the normalized data. The controller selects durations to operate the compressor at one or more of the first and second capacities based on the normalized value of the parameter.

In some configurations, the controller operates the compressor at the second capacity after operating the compressor at the first capacity for the selected duration.

In some configurations, the controller operates the compressor at the second capacity after the first predetermined time period and when the normalized value exceeds a threshold value and when a duration of operating the compressor at the second capacity in response to a prior demand signal exceeds a predefined duration.

In some configurations, before operating the compressor at the second capacity, the controller determines the slope of the data based on the normalized value of the parameter and an additional normalized value of the parameter determined based on additional measured values of the parameter received after the first predetermined time period. The controller selects the durations based on the slope of the data.

In some configurations, the controller receives, during the first and second predetermined time periods, the data including first and second measured values of a parameter indicating the thermal load. The controller determines first and second normalized values of the parameter based on the first and second measured values and the first and second predetermined time periods. The controller determines the slope of the data based on the first and second normalized values. The controller selects a duration to operate the compressor at the first capacity based on the slope of the data.

In some configurations, the controller receives the data including first values of a parameter indicating the thermal load when the demand signal is received. The controller determines a first normalized value of the parameter from the first values. The controller compares the first normalized value to a second normalized value of the parameter stored in the controller when a prior demand signal is de-asserted. The controller determines the slope of the data based on the first and second normalized values. The controller determines durations to operate the compressor at one or more of the first and second capacities based on the slope of the data.

In some configurations, the controller receives the data including values of a parameter indicating the thermal load when the demand signal is received. The controller determines whether the parameter is in a steady state based on the slope of the data for a third predetermined time period. The controller, in response to the parameter being in the steady state, selects a duration to operate the compressor at the first capacity based on a value of the parameter in the steady state.

In another form, a method comprises receiving, at a converter, a demand signal from a thermostat; and generating, using the converter, power based on the demand signal received from the thermostat. The method further comprises controlling, using a controller, a compressor based on the demand signal and the power generated based on the demand signal. The method further comprises obtaining, at the controller, data during a first predetermined time period in a demand cycle, the data indicating thermal load applied to a space conditioned by the compressor. The method further comprises selectively determining, using the controller, a slope of the data after a second predetermined time period in the demand cycle. The method further comprises controlling, using the controller, the compressor based on one or more of a normalized value of the data and the slope of the data determined during the demand cycle.

In some configurations, the method further comprises controlling, using the controller, the compressor based on the slope of the normalized data.

In some configurations, the method further comprises charging, using the converter, a capacitor during the demand cycle. The method further comprises supplying power to the controller from the converter during the demand cycle and from the capacitor during a third predetermined time period after the thermostat de-asserts the demand signal at an end of the demand cycle, the third predetermined time period being less than a time period between successive demand cycles. The method further comprises accessing, using the controller, the data during the demand cycle based on the power received from the converter and during the third predetermined time period based on the power received from the capacitor.

In some configurations, the method further comprises determining, using the controller, the slope of the data based on the normalized data from the demand cycle and based on an additional normalized data determined after the second predetermined time period in the demand cycle or determined in a prior demand cycle.

In some configurations, the method further comprises storing, using the controller, the normalized data from the demand cycle and the additional normalized data determined in the prior demand cycle in a nonvolatile memory. The method further comprises charging, using the converter, a capacitor based on the power generated based on the demand signal during each demand cycle; and supplying the power from the capacitor to the nonvolatile memory at the end of each demand cycle.

In some configurations, the method further comprises in response to the thermostat reasserting the demand signal, reading, using the controller, the stored data from the nonvolatile memory. The method further comprises controlling, using the controller, the compressor based on the read data. In some configurations, the compressor is operable at a first capacity or a second capacity that is greater than the first capacity, and the method further comprises operating, using the controller, the compressor at the first capacity for the first predetermined time period when the demand signal is received.

In some configurations, the method further comprises receiving, at the controller, during the first predetermined time period, the data including measured values of a parameter indicating the thermal load. The method further comprises determining, using the controller, a normalized value of the parameter to generate the normalized value of the data. The method further comprises selecting, using the controller, durations to operate the compressor at one or more of the first and second capacities based on the normalized value of the parameter.

In some configurations, the method further comprises operating, using the controller, the compressor at the second capacity after operating the compressor at the first capacity for the selected duration.

In some configurations, the method further comprises operating, using the controller, the compressor at the second capacity after the first predetermined time period and when the normalized value exceeds a threshold value and when a duration of operating the compressor at the second capacity in response to a prior demand signal exceeds a predefined duration.

In some configurations, the method further comprises before operating, using the controller, the compressor at the second capacity, determining, using the controller, the slope of the data based on the normalized value of the parameter and an additional normalized value of the parameter determined based on additional measured values of the parameter received after the first predetermined time period. The method further comprises selecting, using the controller, the durations based on the slope of the data.

In some configurations, the method further comprises receiving, at the controller, during the first and second predetermined time periods, the data including first and second measured values of a parameter indicating the thermal load. The method further comprises determining, using the controller, first and second normalized values of the parameter based on the first and second measured values and the first and second predetermined time periods. The method further comprises determining, using the controller, the slope of the data based on the first and second normalized values. The method further comprises selecting, using the controller, a duration to operate the compressor at the first capacity based on the slope of the data.

In some configurations, the method further comprises receiving, at the controller, the data including first values of a parameter indicating the outdoor thermal load when the demand signal is received. The method further comprises determining, using the controller, a first normalized value of the parameter based on the first values of the parameter. The method further comprises comparing, using the controller, the first normalized value to a second normalized value of the parameter stored in the controller when a prior demand signal is de-asserted. The method further comprises determining, using the controller, the slope of the data based on the first and second normalized values. The method further comprises determining, using the controller, durations to operate the compressor at one or more of the first and second capacities based on the slope of the data.

In some configurations, the method further comprises receiving, at the controller, the data including values of a parameter indicating the thermal load when the demand signal is received. The method further comprises determining, using the controller, whether the parameter is in a steady state based on the slope of the data for a third predetermined time period. The method further comprises in response to the parameter being in the steady state, selecting, using the controller, a duration to operate the compressor at the first capacity based on a value of the parameter in the steady state.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 7 is a table included in the two-wire climate control system of FIG. 3 providing runtimes for operating the compressor at different capacities according to OAT slope.

Corresponding reference numerals indicate corresponding parts throughout the several views of the drawings.

DETAILED DESCRIPTION

Figure 1:
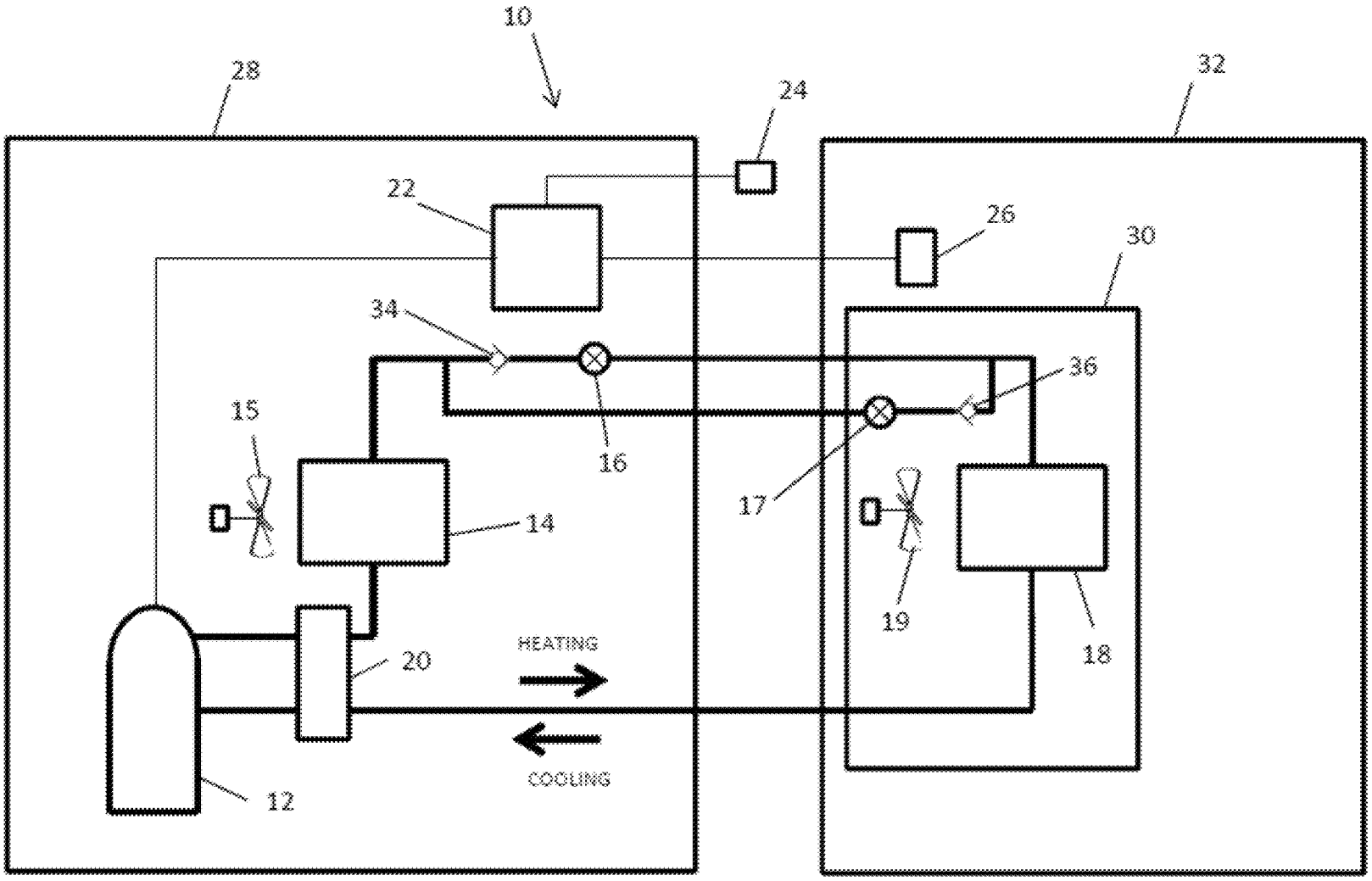
FIG. 1 is a schematic representation of a heat-pump system having a variable-capacity compressor according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a climate-control system 10 is provided that may include a variable-capacity compressor (or a variable-capacity group of compressors) 12, an outdoor heat exchanger 14, an outdoor blower 15, a first expansion device 16, a second expansion device 17, an indoor heat exchanger 18, and an indoor blower 19. In the particular configuration shown in FIG. 1, the system 10 is a heat-pump system having a reversing valve 20 operable to control a direction of working fluid flow through the system 10 to switch the system 10 between a heating mode and a cooling mode. In some configurations, the system 10 may be an air-conditioning system or a refrigeration system, for example, and may be operable in only the cooling mode.

As will be described in more detail below, a controller or control module 22 may control operation of the compressor 12 and may switch the compressor 12 between a low-capacity mode and a high-capacity mode based on data received from an outdoor-air-temperature sensor 24, a signal received from a thermostat 26, a comparison between a runtime T of the compressor 12 and a predetermined low-capacity runtime T1, and/or a comparison between a previous high-capacity runtime T2 with a predetermined value. The control module 22 may minimize or reduce employment of high-capacity-mode operation to minimize or reduce energy usage while maintaining an acceptable level of comfort within a space to be heated or cooled.

The compressor 12 can be or include a scroll compressor, a reciprocating compressor, or a rotary vane compressor, for example, and/or any other type of compressor. The compressor 12 may be any type of variable-capacity compressor that is operable in at least a low-capacity mode and a high-capacity mode. For example, the compressor 12 may be or include a multi-stage compressor, a group of independently operable compressors, a multi-speed or variable-speed compressor (having a variable-speed or multi-speed motor), a compressor having modulated suction (e.g., blocked suction), a compressor having fluid-injection (e.g., an economizer circuit), a pulse-width-modulated scroll compressor configured for scroll separation (e.g., a digital scroll compressor), a compressor having variable-volume-ratio valves configured to leak intermediate-pressure working fluid, or a compressor having two or more of the above capacity modulation means. It will be appreciated that the compressor 12 could include any other additional or alternative structure for varying its capacity and/or the operating capacity of the system 10.

It will be appreciated that the low-capacity and/or high-capacity modes may be continuous, steady-state operating modes, or compressor 12 may be modulated (e.g., pulse-width-modulated) during operation in the low-capacity mode and/or during operation in the high-capacity mode. Exemplary variable-capacity compressors are disclosed in assignee's commonly owned U.S. Pat. Nos. 8,616,014, 6,679,072, 8,585,382, 6,213,731, 8,485,789, 8,459,053, and 5,385,453, the disclosures of which are hereby incorporated by reference.

The compressor 12, the outdoor heat exchanger 14, the outdoor blower 15, the first expansion device 16 and the reversing valve 20 may be disposed in an outdoor unit 28. The second expansion device 17, the indoor heat exchanger 18 and the indoor blower 19 may be disposed within an indoor unit 30 (e.g., an air handler or furnace) disposed within a home or other building 32. A first check valve 34 may be disposed between outdoor heat exchanger 14 and the first expansion device 16 and may restrict or prevent fluid flow through the first expansion device 16 in the cooling mode and may allow fluid flow through the first expansion device 16 in the heating mode. A second check valve 36 may be disposed between the second expansion device 17 and the indoor heat exchanger 18 and may restrict or prevent fluid flow through the second expansion device 17 in the heating mode and may allow fluid flow through the second expansion device 17 in the cooling mode.

The outdoor-air-temperature sensor 24 is disposed outside of the building 32 and within or outside of the outdoor unit 28 and is configured to measure an outdoor ambient air temperature and communicate the outdoor ambient air temperature value to the control module 22 intermittently, continuously or on-demand. In some configurations, the outside-air-temperature sensor 24 could be a thermometer or other sensor associated with a weather monitoring and/or weather reporting system or entity. In such configurations, the control module 22 may obtain the outdoor-air temperature (measured by the sensor 24) from the weather monitoring and/or weather reporting system or entity via, for example, an internet, Wi-Fi, Bluetooth®, Zigbee®, power-line carrier communication (PLCC), or cellular connection or any other wired or wireless communication protocol.

For example, the control module 22 may communicate with the weather monitoring and/or weather reporting system or entity over the internet via a Wi-Fi connection to a Wi-Fi router located in or associated with the building 32. The thermostat 26 is disposed inside of the building 32 and outside of the indoor unit 30 and is configured to measure an air temperature within a room or space to be cooled or heated by the system 10. The thermostat 26 can be a single-stage thermostat, for example, that generates only one type of demand signal in response to a temperature within the room or space rising above (in the cooling mode) or falling below (in the heating mode) a setpoint temperature. The control module 22 could be disposed in any suitable location, such as inside of or adjacent to the outdoor unit 28 or inside of or adjacent to the indoor unit 30, for example.

In the cooling mode, the outdoor heat exchanger 14 may operate as a condenser or as a gas cooler and may cool discharge-pressure working fluid received from the compressor 12 by transferring heat from the working fluid to air forced over the outdoor heat exchanger 14 by the outdoor blower 15, for example. The outdoor blower 15 could include a fixed-speed, multi-speed or variable-speed fan. In the cooling mode, the indoor heat exchanger 18 may operate as an evaporator in which the working fluid absorbs heat from air forced over the indoor heat exchanger 18 by the indoor blower 19 to cool a space within the home or building 32. The indoor blower 19 could include a fixed-speed, multi-speed or variable-speed fan. In the heating mode, the outdoor heat exchanger 14 may operate as an evaporator, and the indoor heat exchanger 18 may operate as a condenser or as a gas cooler and may transfer heat from working fluid discharged from the compressor 12 to a space to be heated.

Figure 2:
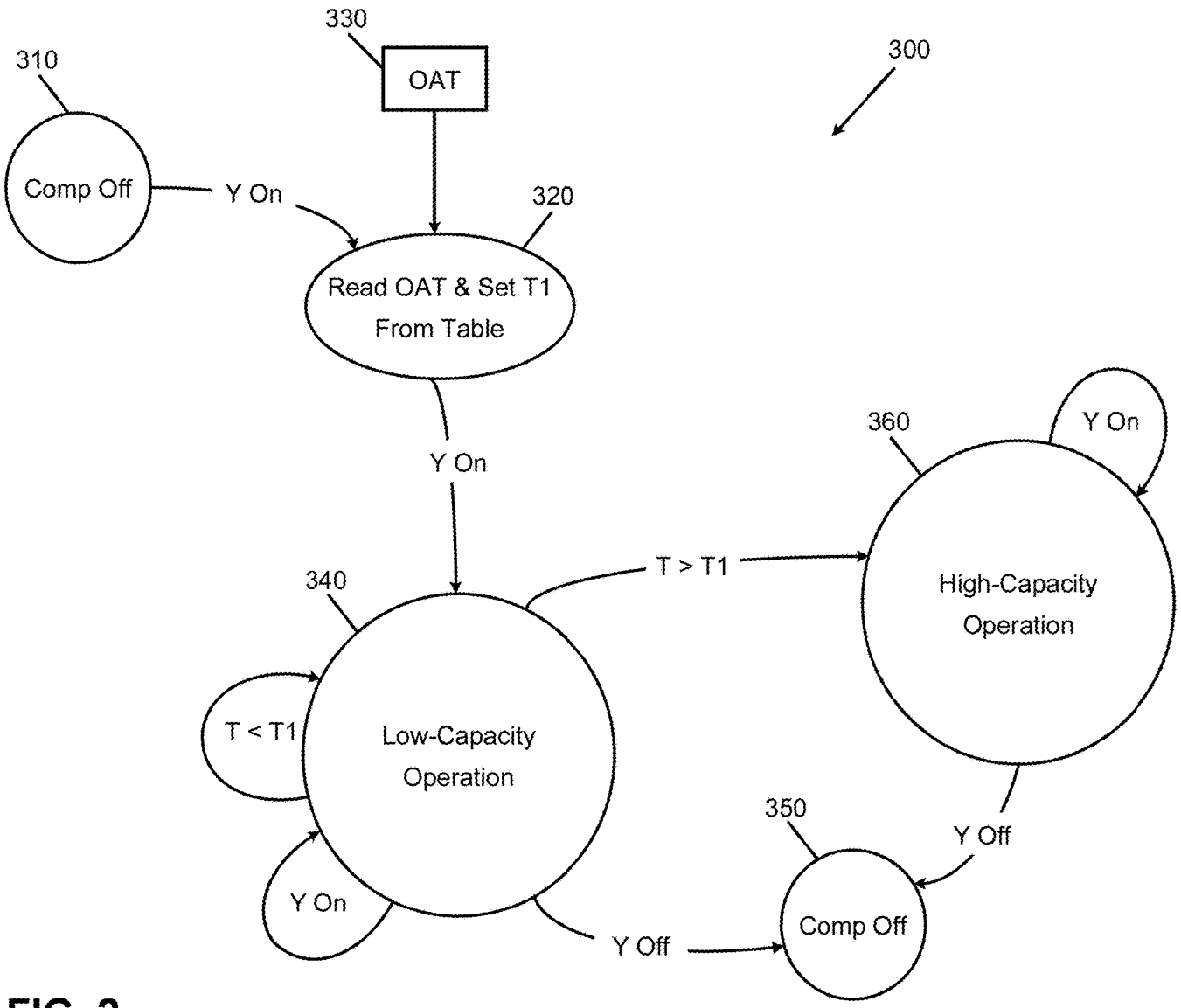
FIG. 2 is a state diagram illustrating a method for controlling the variable-capacity compressor of FIG. 1.

Referring now to FIG. 2, a method 300 will be described that can be executed by the control module 22. The method 300 may control operation of the compressor 12 and switch the compressor 12 between the low-capacity and high-capacity modes. In an initial state 310, the compressor 12 may be off. The thermostat 26 may send a demand signal Y to the control module 22 in response to an air temperature in the space to be heated or cooled by the system 10 dropping below (in the heating mode) or rising above (in the cooling mode) a selected setpoint temperature. In response to receipt of the demand signal Y, the control module 22 may initiate operation of the compressor 12 in the low-capacity mode (state 340) and simultaneously, at state 320, read an outdoor air temperature (received from sensor 24 at input 330) and set a low-capacity runtime T1 based on data from a table (see FIG. 7). Thereafter, the compressor 12 may continue to run in the low-capacity mode until the cooling demand is satisfied (i.e., the temperature in the space to be cooled drops below the selected setpoint temperature as indicated by the thermostat 26 and the thermostat switches the demand signal Y to "off"), until the total runtime T of the compressor 12 since the receipt of the demand signal Y surpasses the low-capacity runtime T1 set at state 320, or until the compressor 12 or system 10 is manually shutdown or a diagnostic or protection scheme overrides the method 300 or the control module 22 is powered off.

If demand is satisfied before the total runtime T reaches the predetermined low-capacity runtime T1, the control module 22 may shutdown the compressor 12 (state 350). If the compressor 12 has been running for longer than the predetermined low-capacity runtime T1 without satisfying the demand, the control module 22 may switch the compressor 12 from the low-capacity mode to the high-capacity mode (state 360). The compressor 12 may continue to run in the high-capacity mode until the cooling demand is satisfied (or until the compressor 12 or system 10 is manually shutdown or a diagnostic or protection scheme overrides the method 300 or the control module 22 is powered off). When demand is satisfied, the control module 22 may shutdown the compressor 12 (state 350). When the compressor 12 is shut down after satisfying demand by operating in the high-capacity mode, the control module 22 may record the runtime T2 of the compressor 12 in the high-capacity mode and store the high-capacity runtime T2 in a memory module associated with the control module 22.

Many climate control systems use a three wire scheme, where a thermostat and fan blower module located indoors are connected by three wires to an outdoor control unit located outdoors to control a compressor. The three wires include a first wire carrying a demand signal from the thermostat to the outdoor control unit, a second wire carrying a power supply (e.g., 24 VAC) from the thermostat to the outdoor control unit, and a third wire that is common (to complete an electrical circuit) between the thermostat and the outdoor control unit. The power supply from the thermostat allows the outdoor control unit to continuously monitor OAT, normalize the OAT (i.e., smooth out spikes in the OAT due to solar radiation), and calculate OAT slope. Operating the compressor using runtimes selected based on the normalized OAT and the OAT slope improves the performance of the climate control systems.

Eliminating the second wire that supplies power from the thermostat to the outdoor control unit results in a two wire scheme that can save significant installation cost by reducing a contractor's effort and time spent in installation. Having additional 2-wire algorithms/modules therefore allows the contractor to implement the compressor control described below without the additional effort of pulling a wire between indoor and outdoor units (which can be cumbersome in old houses which are not built to pull wires through or in houses with longer distance between indoor and outdoor units). In the two wire scheme, the thermostat is connected to the outdoor control unit by only two wires: a first wire carrying the demand signal from the thermostat to the outdoor control unit, and a second wire that is common (to complete an electrical circuit) between the thermostat and the outdoor control unit. There is no additional wire carrying power supply from the thermostat to the outdoor control unit.

In the two wire scheme, the outdoor control unit includes a power converter that receives the demand signal from the thermostat at a start of a demand cycle. The demand signal is generally 24 VAC. The power converter converts the demand signal from 24 VAC to a DC power signal having a suitable DC voltage (e.g., 5 VDC) to operate the outdoor control unit. The power converter also charges a capacitor in the outdoor control unit using the DC power signal. When the thermostat de-asserts the demand signal at the end of the demand cycle, the converter can no longer generate the DC power signal. Instead, the capacitor supplies the DC power to the outdoor control unit. The outdoor control unit saves operating parameters for controlling the compressor in a nonvolatile memory and switches to a power save mode until the thermostat reasserts the demand signal in a next demand cycle. When the thermostat reasserts the demand signal in the next demand cycle, the power converter generates the power signal based on the demand signal, supplies power to the outdoor control unit, and recharges the capacitor.

Figure 3:
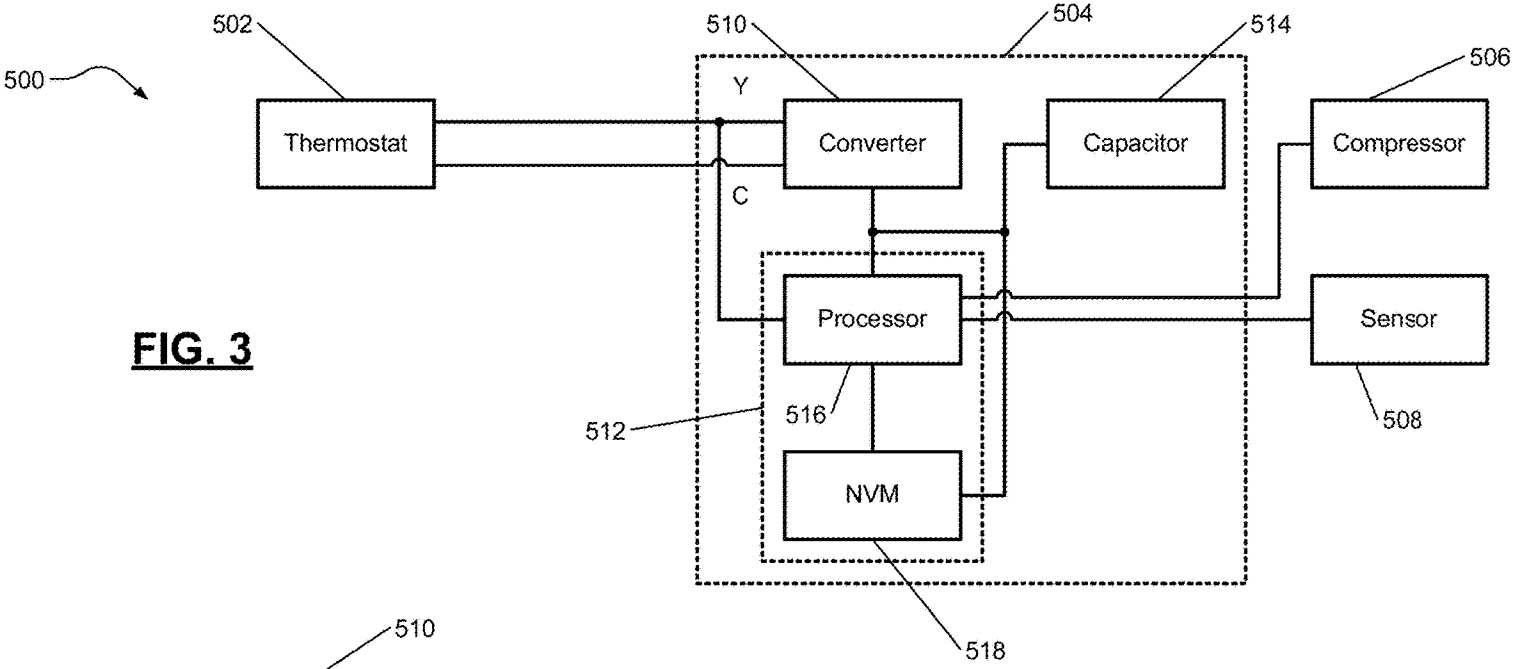
FIG. 3 is a schematic representation of a two-wire climate control system including a controller to control a compressor that does not receive power supply from the thermostat according to the present disclosure.

FIG. 3 shows a climate control system 500 according to the present disclosure. The system 500 includes a thermostat 502, an outdoor control unit 504, a compressor 506, and a sensor 508. The thermostat 502 is connected to the outdoor control unit using only two wires: a first wire carrying a demand signal Y and a second wire C that is common (to complete an electrical circuit) between the thermostat 502 and the outdoor control unit 504. The thermostat 502 does not supply power via a separate third wire to the outdoor control unit 504. The outdoor control unit 504 does not receive power supply from the thermostat 502 or from any other power source. The outdoor control unit 504 generates power for its operation solely based on the demand signal Y received from the thermostat 502. The outdoor control unit 504 controls the compressor 506. The compressor 506 includes a variable capacity compressor. For example, the compressor 506 may include a scroll compressor having a first capacity and a second capacity that is greater than the first capacity. Throughout the present disclosure, Y1 mode and Y1 stage mean the first (low) capacity, and Y2 mode and Y2 stage mean the second (high) capacity.

The outdoor control unit 504 includes a power converter (hereinafter "converter") 510, a controller 512, and a capacitor 514. The converter 510 is connected to the thermostat 502 by only two wires: the first wire carrying the demand signal Y and the second wire C that is common between the thermostat 502 and the outdoor control unit 504. When the thermostat 502 asserts the demand signal Y, the converter 510 generates a power signal based on the demand signal. The power signal from the converter 510 supplies power to the controller 512 and charges the capacitor 514. For example, the converter may include an AC to DC converter that converts a 24 VAC demand signal to a 5 VDC power signal.

The controller 512 includes a processor 516 and a nonvolatile memory 518. The processor 516 controls the compressor 506 based on parameters stored in the nonvolatile memory 518. The processor 516 selects the parameters based on an outdoor thermal load (e.g., OAT) sensed by the sensor 508. The processor 516 selects the parameters during a demand cycle. A demand cycle is a period of time from when the thermostat 502 asserts the demand signal Y to when the thermostat 502 de-asserts the demand signal Y. A time between two consecutive demand cycles is a time between when the thermostat 502 de-asserts the demand signal Y in a first (e.g., present) demand cycle to when the thermostat 502 reasserts the demand signal Y in a second (e.g., next or immediately following the present) demand cycle.

Figure 4:
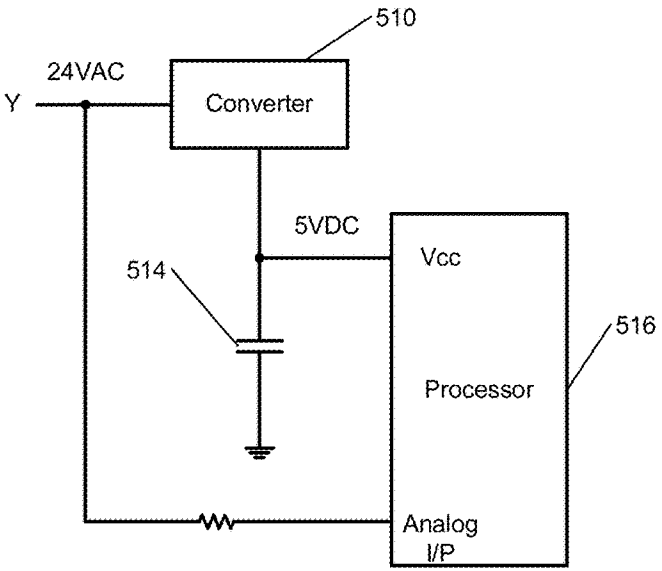
FIG. 4 is a schematic of the controller of the two-wire climate control system of FIG. 3.

As shown in FIGS. 3 and 4, the processor 516 receives the demand signal Y. When the thermostat 502 de-asserts the demand signal Y, the processor 516 detects that the demand signal Y is de-asserted. While the converter 510 no longer generates the power signal after the demand signal Y is de-asserted, the processor 516 receives power from the capacitor 514 after the demand signal Y is de-asserted. Based on the power received from the capacitor 514 after the demand signal Y is de-asserted, the processor 516 saves the parameters for controlling the compressor 506 in the nonvolatile memory 518 after the demand signal Y is de-asserted. The processor 516 enters a power save mode after saving the parameters. The processor 516 remains in the power save mode until the thermostat 502 reasserts the demand signal Y in a next (immediately following the present) demand cycle. When the thermostat 502 reasserts the demand signal Y in the next demand cycle, the converter 510 generates the power signal. The power signal supplies power to the controller 512 and recharges the capacitor 514. After receiving the power signal from the converter 510, the processor 516 retrieves the parameters stored in the nonvolatile memory 518 and controls the compressor 506 based on the retrieved parameters.

Figure 5:
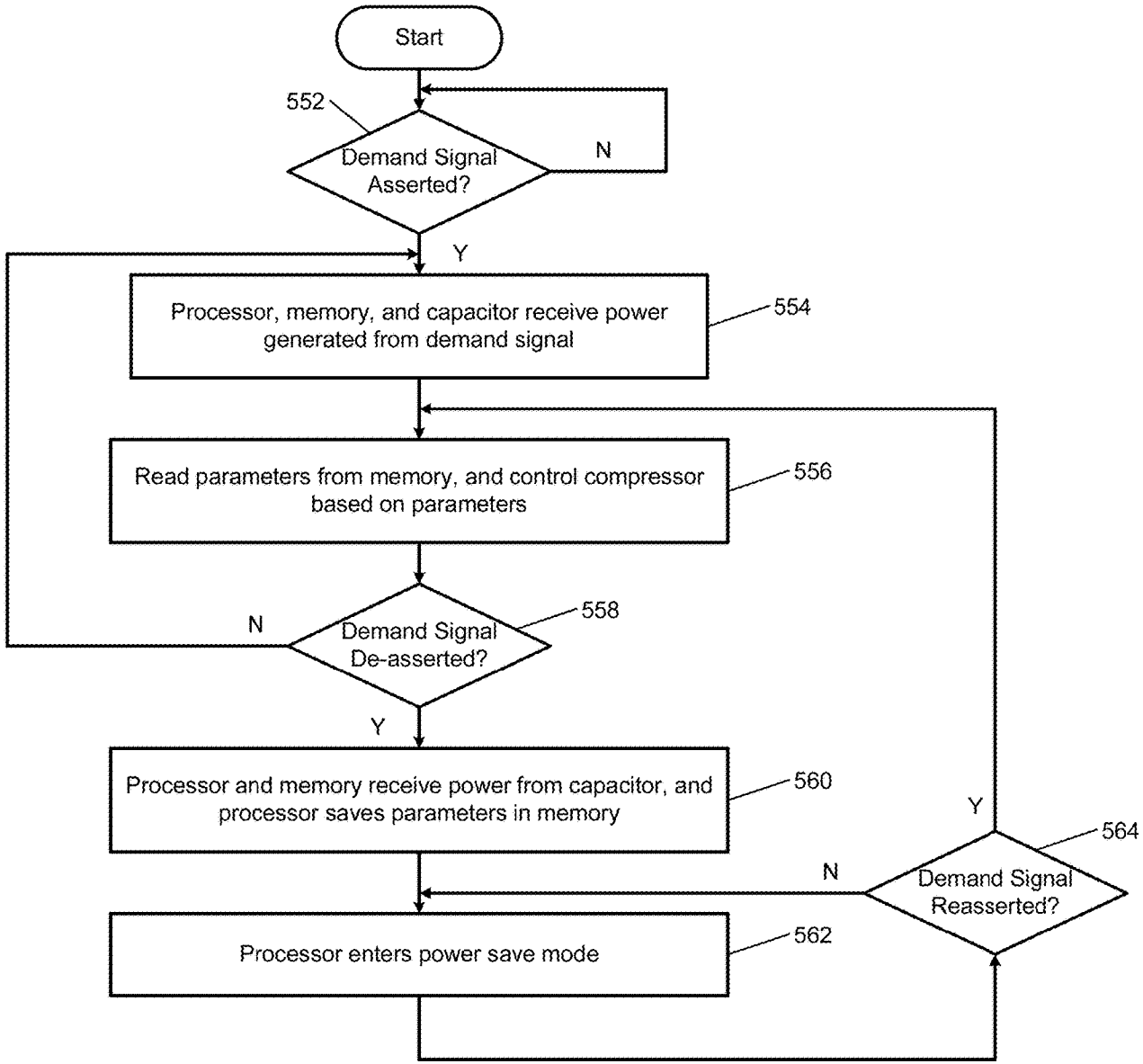
FIG. 5 shows a flowchart of a method for operating an outdoor unit of the two-wire climate control system of FIG. 3.

FIG. 5 shows a method 550 for operating the outdoor control unit 504 using a two wire scheme according to the present disclosure. At 552, control determines whether the demand signal is asserted by the thermostat 502. At 554, if the demand signal is asserted, the processor 516, the nonvolatile memory 518, and the capacitor 514 receive power generated from the demand signal by the converter 510 of the outdoor control unit 504. At 556, control reads parameters from the nonvolatile memory 518 and controls the compressor 506 based on the parameters read from the nonvolatile memory 518. At 558, control determines whether the demand signal is de-asserted by the thermostat 502. Control returns to 554 if the demand signal is not de-asserted by the thermostat 502. At 560, if the demand signal is de-asserted by the thermostat 502, the processor 516 and the nonvolatile memory 518 receive power from the capacitor 514, and the processor saves the parameters in the nonvolatile memory. At 562, the processor 516 enters power save mode. At 564, control determines whether the demand signal is reasserted by the thermostat 502. Control returns to 562 if the demand signal is not reasserted by the thermostat 502. Control returns to 556 if the demand signal is reasserted by the thermostat 502.

Examples of the parameters saved in the nonvolatile memory 518 include high capacity runtime status (e.g., whether the high capacity runtime of the compressor 506 in the present demand cycle is greater or less than a threshold); and OAT value, OAT slope value, and OAT slope status (positive, negative, or neutral) from the previous demand cycle.

In the nonvolatile memory 518 (e.g., flash memory and electrically erasable programmable read only memory (EEPROM)), data can be written to a memory location a limited number of times. To enhance the useful life of the nonvolatile memory 518, data may be written in different memory locations during different demand cycles. For example, the parameters may be stored in a first portion of the nonvolatile memory 518 at the end of a first demand cycle and in a second portion of the nonvolatile memory 518 at the end of a second demand cycle, and so on.

Other aspects of the present disclosure described below include: normalization of the OAT during a single (present) demand cycle since power supply is not available from the thermostat for continuous monitoring and normalization of the OAT; a time-based OAT slope determination during a single (present) demand cycle; a demand cycle-based OAT slope determination during a single (present) demand cycle; and time and demand cycle based OAT slope determination during a single (present) demand cycle.

Most systems can perform continuous monitoring and normalization of the OAT because power supply is constantly available from the thermostat regardless of demand. The two-wire scheme according to the present disclosure, however, does not receive constant power supply from the thermostat as described above. Accordingly, instead of continuously normalizing OAT (e.g., normalizing OAT every minute) irrespective of whether demand is on or off, the system according to the present disclosure (e.g., the system 500 of FIG. 3) normalizes OAT as follows.

The controller 512 starts the compressor 506 in a low capacity mode (called Y1 stage) for a small predetermined period (runtime or RT) (e.g., M minutes, where M may be 3 to 5 minutes) when the demand signal is received from the thermostat 502.

OAT normalization (e.g., averaging) is performed only during one demand cycle (i.e., between assertion and de-assertion of the demand signal during the present demand cycle).

During the small predetermined RT, the processor 516 receives a plurality of OAT values sensed by the sensor 508. While OAT is used as an example of the outdoor thermal load, other or additional parameter(s) indicative of the outdoor thermal load may also be used. The processor 516 processes the plurality of OAT values received from the sensor 508 during the small predetermined RT and generates a normalized OAT value at the end of the small predetermined RT. Accordingly, after the small predetermined RT, the normalized OAT value ($\overline{OAT}$) is available. The processor 516 uses the normalized OAT value to look up the runtimes to operate the compressor 506 in a low capacity mode (Y1 stage) and a high capacity mode (Y2 stage), which are respectively called Y1 and Y2 runtimes (RTs). The processor 516 looks up the Y1 and Y2 RTs corresponding to the OAT range indicated by the normalized OAT value in an extended table (with slope). An example of the extended table is shown in FIG. 7.

The processor switches the operation of the compressor 506 to the Y2 stage after the total time elapsed since the compressor 506 started operating in the Y1 stage is greater than or equal to the Y1 RT. This allows at least 3-5 minutes of Y1 RT before switching to the Y2 mode. Even if OAT is very high and last stage RT in an immediately preceding demand cycle was greater than a pre-assigned value, the compressor 506 continues to run in the Y1 stage for at least 3-5 minutes.

If the thermostat 502 de-asserts the demand signal Y during the small predetermined RT, then operating the compressor 506 in the low stage Y1 was the appropriate mode. If the thermostat 502 does not de-assert the demand signal Y during the small predetermined RT and OAT is high, the processor 516 switches the operation of the compressor 506 to the Y2 stage. If the thermostat 502 does not de-assert the demand signal Y during the small predetermined RT and OAT is low, a direct high (Y2) stage run of the compressor 506 is avoided, which could have been a short Y2 cycle. Avoiding direct Y2 cycles (which can also be short in duration) as the system 500 does improves system performance since the Y2 cycles of the compressor 506 consume up to 20% more energy than Y1 cycles of the compressor 506.

Figure 6:
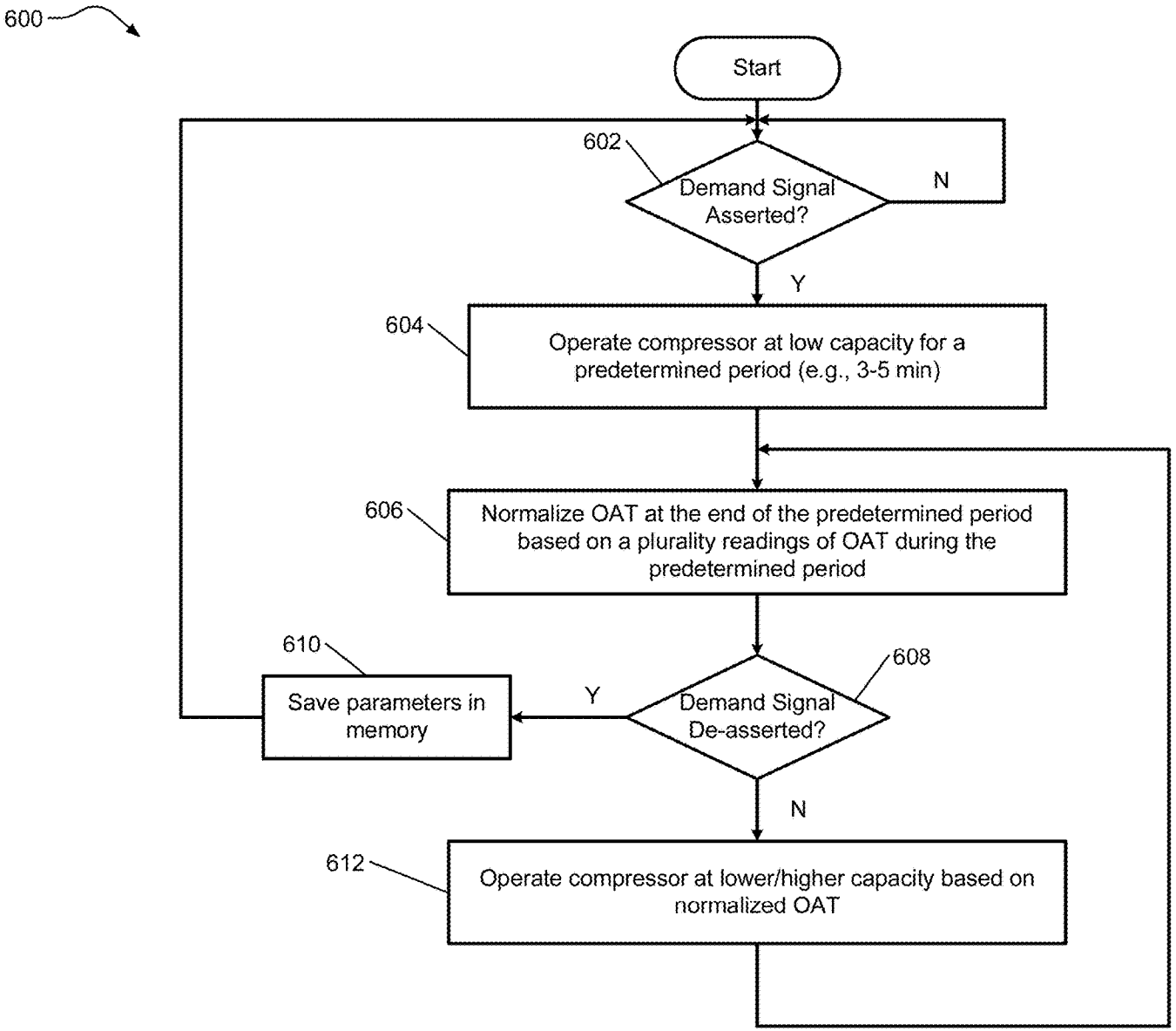
FIG. 6 shows a flowchart of a method for normalizing outdoor thermal load (e.g., OAT) in the two-wire climate control system of FIG. 3.

FIG. 6 shows a method 600 for normalizing OAT according to the present disclosure. At 602, control determines whether the demand signal is asserted. At 604, control operates the compressor 506 at the low capacity Y1 for a predetermined period (e.g., 3 to 5 minutes). At 606, control normalizes OAT at the end of the predetermined period based on a plurality of readings of OAT during the predetermined period. At 608, control determines whether the demand signal is de-asserted. At 610, if the demand signal is de-asserted, control saves the operating parameters for the compressor 506 in the nonvolatile memory 518, and control returns to 602. At 612, if the demand signal is not de-asserted, control operates the compressor 506 at the low and/or high capacities based on the normalized OAT, and control returns to 606.

The system 500 can determine OAT slope during a single (present) demand cycle using a time-based method and/or a demand cycle based method. The time based OAT slope determination method is described below with reference to FIG. 9. A combined OAT normalization and time based OAT slope determination method is described below with references to FIGS. 10 and 11. The demand cycle based OAT slope determination method is described below with references to FIGS. 12A and 12B.

The time-based method for determining the OAT slope is as follows. The processor 516 operates the compressor 506 at the first capacity (Y1) for a predetermined time period when the demand signal is received from the thermostat 502. During the predetermined time period, the processor 516 receives a plurality of OAT readings from the sensor 508. At the end of the predetermined time period, the processor 516 determines a normalized OAT value based on the plurality of OAT readings received from the sensor 508 during the predetermined time period. For example, if the predetermined time period is three minutes, the normalized OAT value at the end of the predetermined time period is called $\overline{OAT_{T=3}}$. Following the predetermined time period, an additional (second) normalized OAT value called $\overline{OAT_{T=6}}$ is determined at the end of an additional (second) predetermined time period. For example, the additional (second) predetermined time period may be an additional three minutes after the predetermined time period from receiving the demand signal (e.g., six minutes from receiving the demand signal).

If $\overline{OAT_{T=6}}-\overline{OAT_{T=3}}>X$; the OAT slope is positive. If $\overline{OAT_{T=6}}-\overline{OAT_{T=3}}<X$; the OAT slope is negative. Based on the OAT slope, the processor 516 looks up the Y1/Y2 run times for the compressor 506 in the slope based runtime table (called extended table) shown in FIG. 7 and operates the compressor in Y1/Y2 modes (i.e., in the low and/or high capacity modes) according to the runtimes in the extended table shown in FIG. 7. If the OAT slope is neither positive nor negative, the processor 516 looks up the Y1/Y2 runtimes for the compressor 506 in the normalized OAT based runtime table without OAT slope factored in (called baseline table) shown in FIG. 8 and operates the compressor in Y1/Y2 modes (i.e., in the low and/or high capacity modes) according to the runtimes in the baseline table shown in FIG. 8. The processor 516 switches the operation of the compressor 506 to the Y2 mode after the Y1 runtime elapses if the demand signal still remains asserted at the end of the Y1 runtime. The time difference between two normalized OAT values can be any predetermined (reasonably low) value (e.g., between 3 to 10 minutes).

The processor 516 operates the compressor 506 in the Y1 stage until the OAT slope is determined with an exception. The exception is that the processor 516 switches the operation of the compressor to the Y2 mode before the OAT slope is determined when $\overline{OAT_{T=3}}>90$ and last Y2RT>X minutes. That is, the processor 516 switches the operation of the compressor to the Y2 stage before the OAT slope is determined if two conditions are satisfied: first, the normalized OAT at the end of the predetermined period (e.g., 3-5 minutes) after receiving the demand signal is greater than or equal to a predetermined value (e.g., 90 degrees); and second, the runtime of the compressor 506 in Y2 stage in an immediately preceding demand cycle (i.e., when the immediately preceding demand signal was de-asserted) is greater than or equal to a predefined value.

All runtimes (RTs) are counted from the start of the present demand cycle (i.e., from the time of receiving the demand signal from the thermostat 502 in the present demand cycle). When slope detection is completed, neither the predetermined time period (i.e., the small predetermined RT) nor the runtime of the compressor 506 in the Y1 stage is reset. Instead, the compressor 506 is operated for the remaining portion of the selected Y1 runtime. For example, after the slope detection is completed, if the Y1 runtime based on the slope is T minutes, the compressor 506 is operated in the Y1 stage for T minus 6 minutes (in the above example, the slope determination is completed at the end of 6 minutes from the start of the demand cycle).

Figure 9:
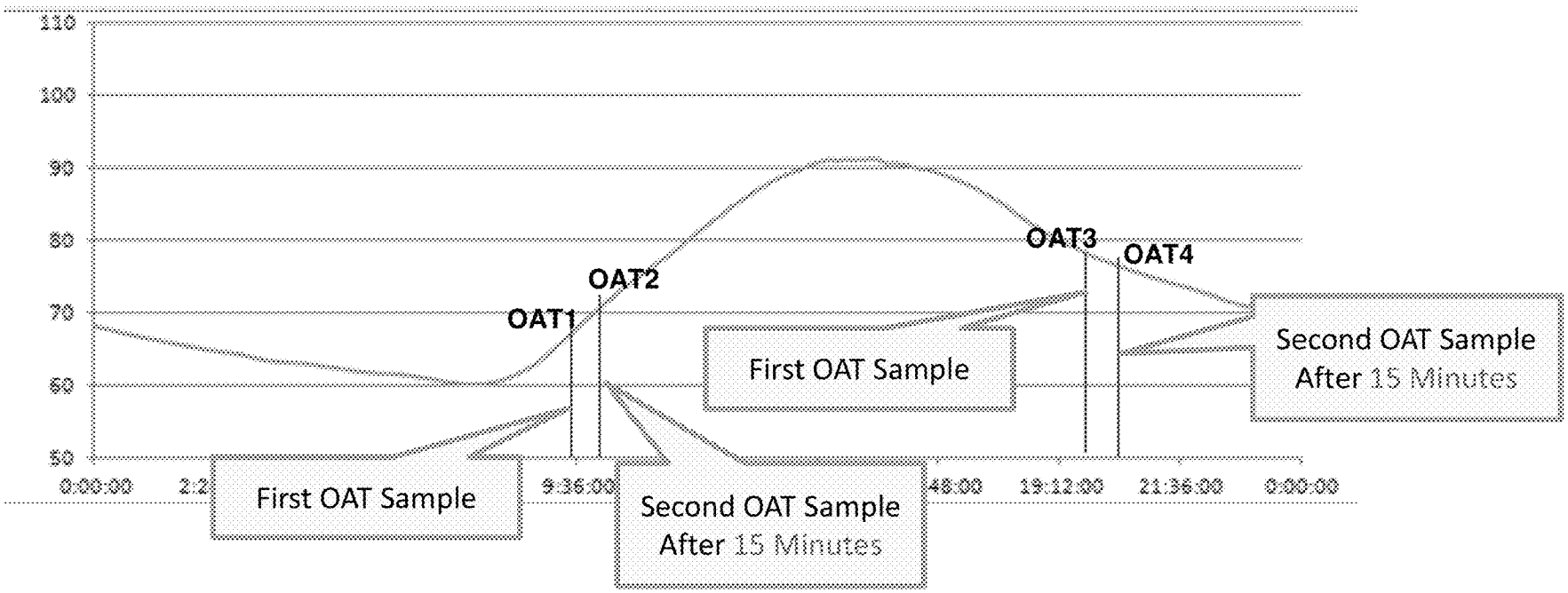
FIG. 9 shows an example of a method for time based OAT slope determination in the two-wire climate control system of FIG. 3.

FIG. 9 shows an example of the time based OAT slope determination method according to the present disclosure. In the example shown, if ((OAT2−OAT1)/Slope Interval) >'OAT Positive Slope Cutoff', a rising OAT profile or positive OAT slope is detected. If ((OAT3−OAT4)/Slope Interval)>'OAT Negative Slope Cutoff', a falling OAT profile or negative OAT slope is detected. For example only, Slope Interval=15 minutes; and other durations may be used for the Slope Interval.

In the above equations, the OAT Positive Slope Cutoff is the slope value above which the OAT profile will be treated as rising (Example: If Positive Slope Cut Off=0.2, OAT profile will be considered as rising if the OAT slope exceeds 0.2). The OAT Negative Slope Cutoff is the slope value below which the OAT profile will be treated as falling (Example: If Negative Slope Cut Off=0.2, OAT profile will be considered as falling if the OAT slope comes below 0.2). The Slope Interval is the time interval for which the OAT slope will be determined.

Figures 8, 10:
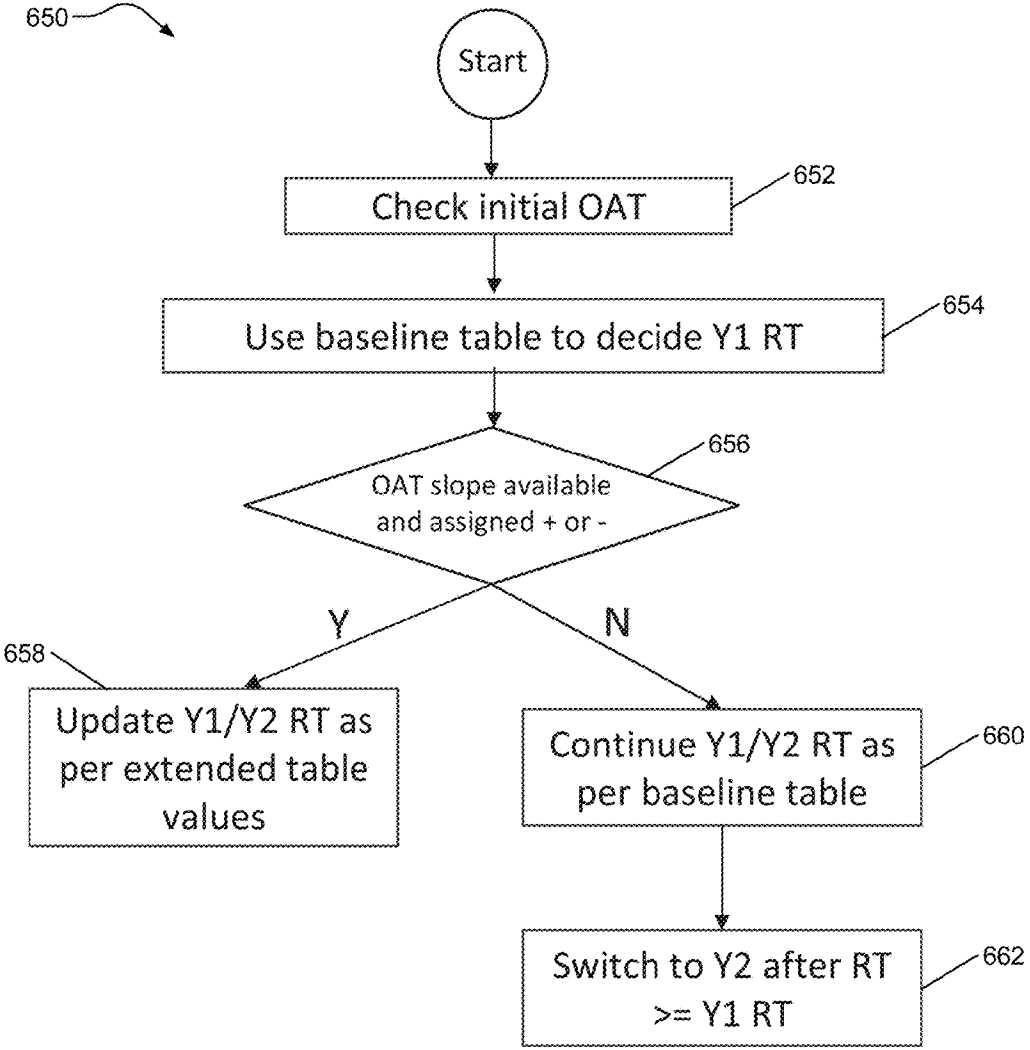
FIG. 8 is a table included in the two-wire climate control system of FIG. 3 providing runtimes for operating the compressor at different capacities according to OAT value.
FIG. 10 shows a combined method for OAT normalization and time based OAT slope determination in the two-wire climate control system of FIG. 3.

FIG. 10 shows an example of a method 650 combining OAT normalization and time based OAT slope determination during a single (present) demand cycle according to the present disclosure. At 652, control checks initial OAT value after receiving the demand signal from the thermostat 502 at the start of the demand cycle.

At 654, control determines a runtime to operate the compressor 506 in Y1 stage based on the initial OAT value by looking up the baseline table shown in FIG. 8. At 656, control determines whether OAT slope is determined. At 658, if the OAT slope is determined, control updates the runtimes for operating the compressor 506 in one or more of Y1 and Y2 modes based on the OAT slope according to the extended table shown in FIG. 7. At 660, if the OAT slope is not determined, control continues to operate the compressor 506 in one or more of Y1 and Y2 modes based on the initial OAT value according to the baseline table shown in FIG. 8.

Figure 11:
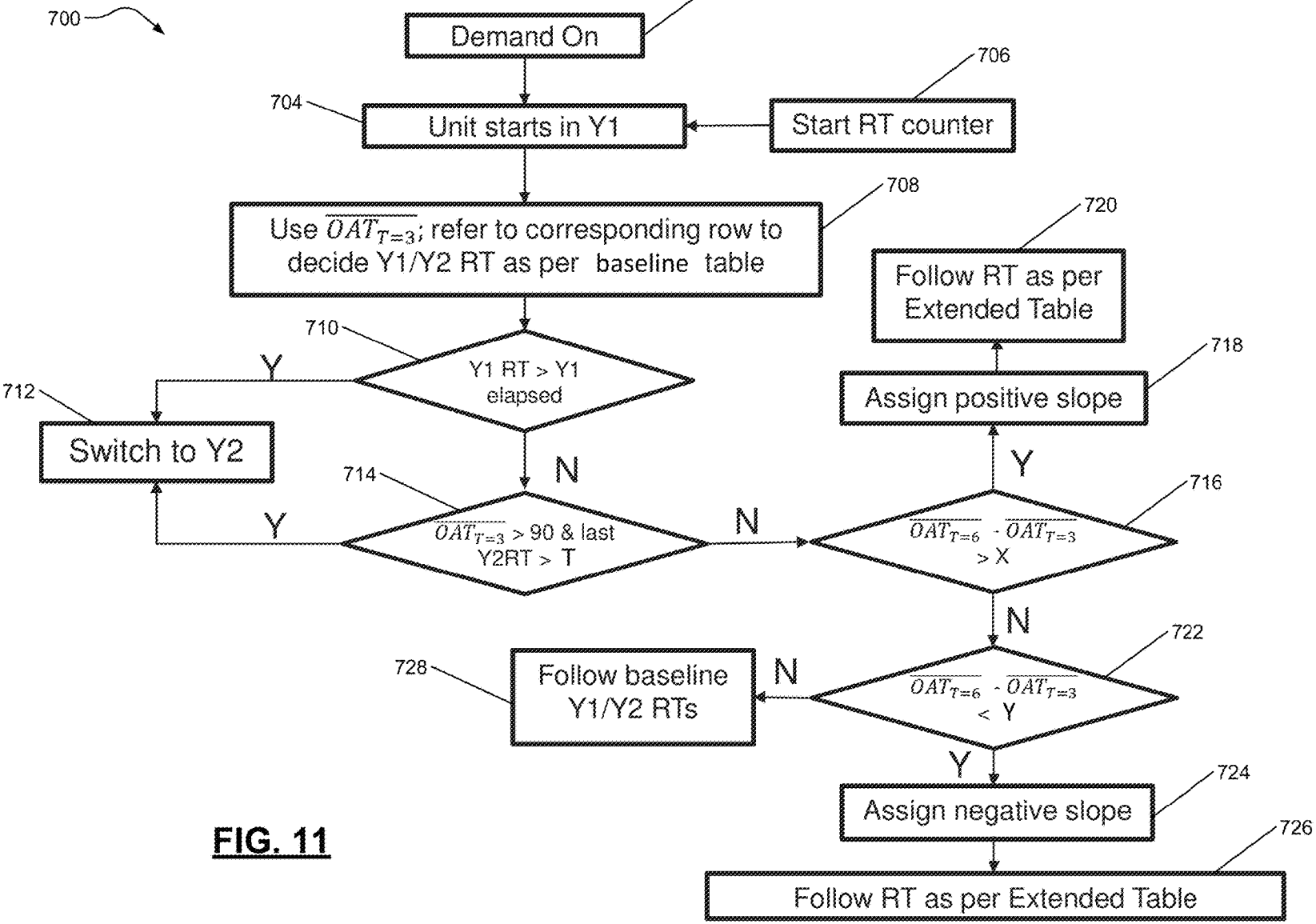
FIG. 11 shows a combined method for OAT normalization and time based OAT slope determination in the two-wire climate control system of FIG. 3.

FIG. 11 shows a method 700 for a combined OAT normalization and time based OAT slope determination during a single (present) demand cycle according to the present disclosure. At 702, control receives the demand signal from the thermostat 502. At 704, control operates the compressor 506 in the low capacity (Y1) mode. At 706, control starts a runtime counter that counts a predetermined time period (e.g., 3-5 minutes) for which the compressor 506 is operated in the Y1 stage. At 708, at the end of the predetermined time period, control determines a normalized value of the OAT and selects runtimes to operate the compressor 506 at the first and/or second capacity (i.e., Y1/Y2 runtimes) based on the normalized OAT value according to the baseline table shown in FIG. 8.

At 710, control determines whether the Y1 runtime (i.e., the runtime to operate the compressor and the low capacity (Y1) stage) has elapsed. At 712, if the Y1 runtime has elapsed, control switches the operating mode of the compressor 506 to Y2 (i.e., to the high-capacity mode). At 714, if the Y1 runtime has not elapsed, control determines whether the normalized OAT is greater than or equal to a predetermined value (e.g., 90 degrees) and a Y2 runtime of the compressor 506 in an immediately preceding demand cycle was greater than or equal to a predetermined duration. Control returns to 712 if the normalized OAT is greater than or equal to the predetermined value (e.g., 90 degrees) and the Y2 runtime of the compressor 506 in the immediately preceding demand cycle was greater than or equal to the predetermined duration.

At 716, if the normalized OAT is not greater than or equal to the predetermined value (e.g., 90 degrees) or the Y2 runtime of the compressor 506 in the immediately preceding demand cycle was not greater than or equal to a predetermined duration, control determines whether a difference between two normalized values of OAT is greater than a first predetermined threshold. For example, the two normalized values of OAT may be determined at the end of a first predetermined time period and at the end of a second predetermined time period counted from the beginning of the demand cycle. For example, the two normalized values of OAT may be determined at the end of three minutes and at the end of six minutes counted from the beginning of the demand cycle (i.e., from when the demand signal was received from the thermostat 502 in the present demand cycle).

At 718, if the difference between the two normalized OAT values is greater than the first predetermined threshold, control assigns a positive value to the OAT slope. At 720, control selects runtimes to operate the compressor 506 at the first and/or second capacity (i.e., Y1/Y2 runtimes) based on the OAT slope according to the extended table shown in FIG. 7.

At 722, if the difference between the two normalized values of OAT is not greater than the first predetermined threshold, control determines whether the difference between the two normalized values of OAT is less than a second predetermined threshold. At 724, if the difference between the two normalized OAT values is less than the second predetermined threshold, control assigns a negative value to the OAT slope. At 726, control selects runtimes to operate the compressor 506 at the first and/or second capacity (i.e., Y1/Y2 runtimes) based on the OAT slope according to the extended table shown in FIG. 7.

At 728, if the difference between the two normalized OAT values is not less than the second predetermined threshold (and not greater than the first predetermined threshold), control selects runtimes to operate the compressor 506 at the first and/or second capacity (i.e., Y1/Y2 runtimes) according to the baseline table shown in FIG. 8.

Figure 12A:
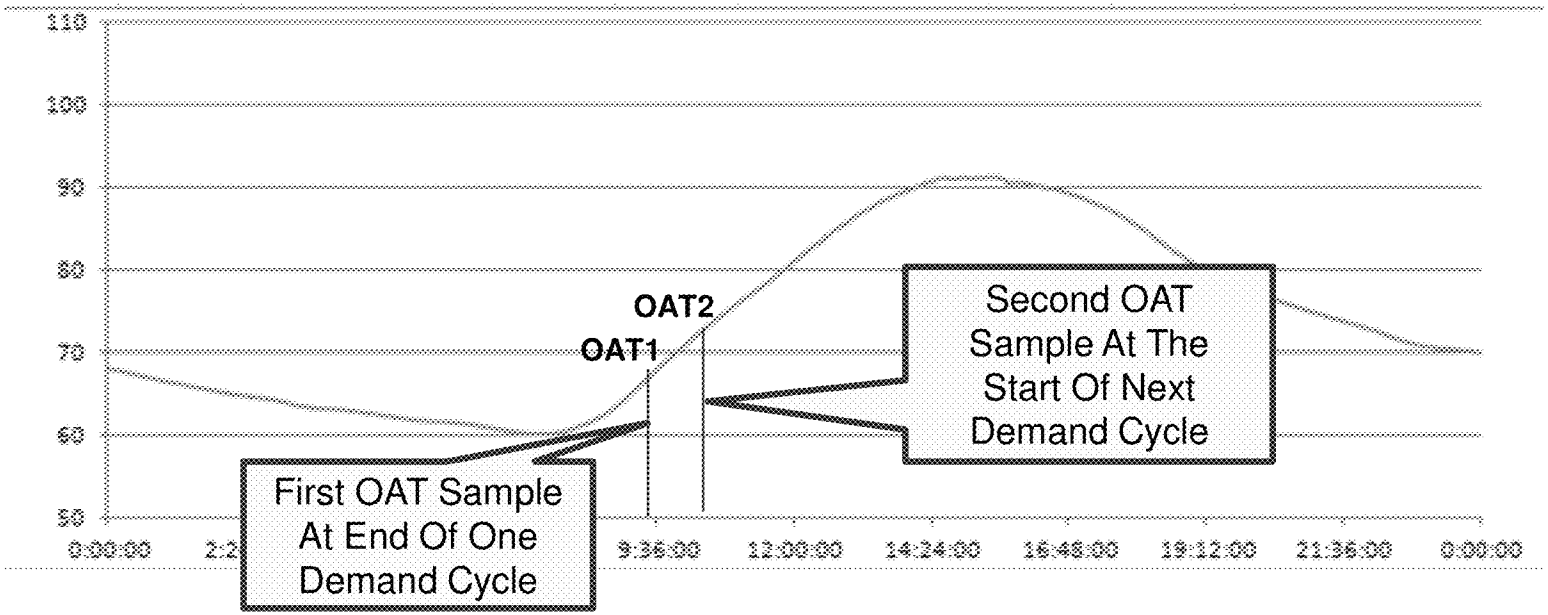
FIGS. 12A and 12B show examples of demand cycle based OAT slope determination in the two-wire climate control system of FIG. 3.
Figure 12B:
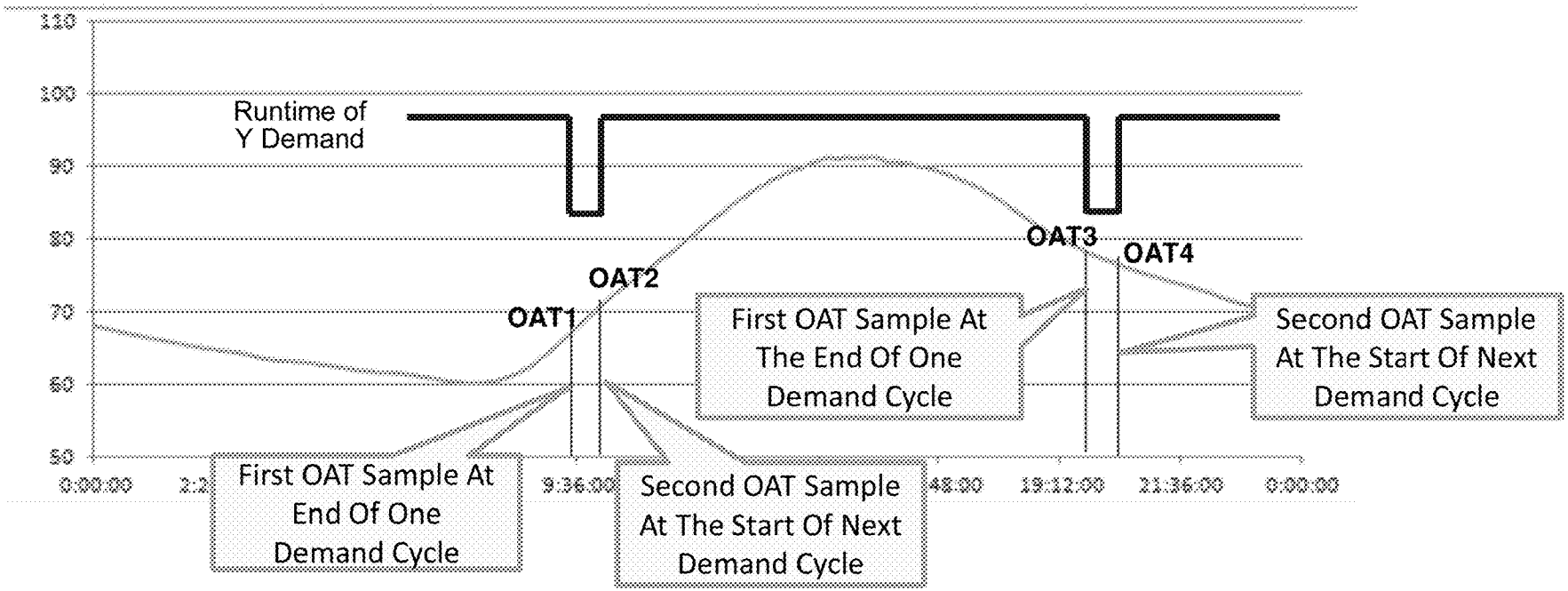

FIGS. 12A and 12B show an example of a demand cycle-based method for determining OAT slope. In FIG. 12A, a difference between raw or normalized OAT values at the beginning of the present demand cycle and at the end of an immediately preceding demand cycle is used to determine the OAT slope at the beginning of the present demand cycle. If the time (off time) between two consecutive demand cycles is greater than a predetermined extended time period (e.g., 3 hours), instead of determining the OAT slope and using the slope based runtimes shown in the extended table in FIG. 7, the processor 516 uses the runtimes shown in the baseline table in FIG. 8 to operate the compressor 506.

In FIG. 12B, If (OAT2−OAT1)>'OAT Positive Slope Cutoff', a rising OAT profile or positive OAT slope is detected. If (OAT3−OAT4)>'OAT Negative Slope Cutoff', a falling OAT profile or negative OAT slope is detected. For example only, OAT Positive Slope Cutoff=0.35; and OAT Negative Slope Cutoff=0.35.

Figure 13A:
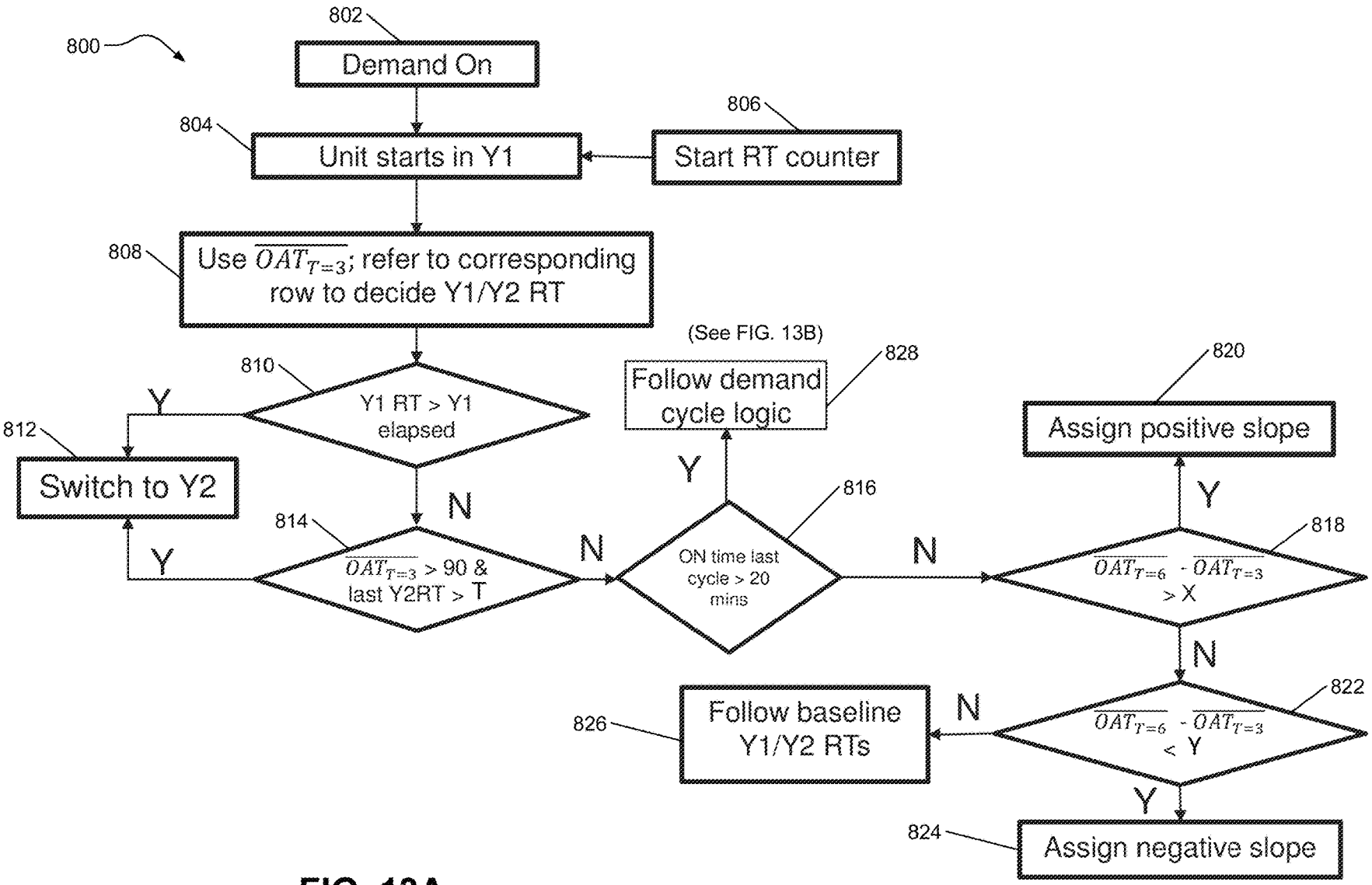
FIGS. 13A and 13B show a combined method for time and demand cycle based OAT slope determination in the two-wire climate control system of FIG. 3.
Figure 13B:
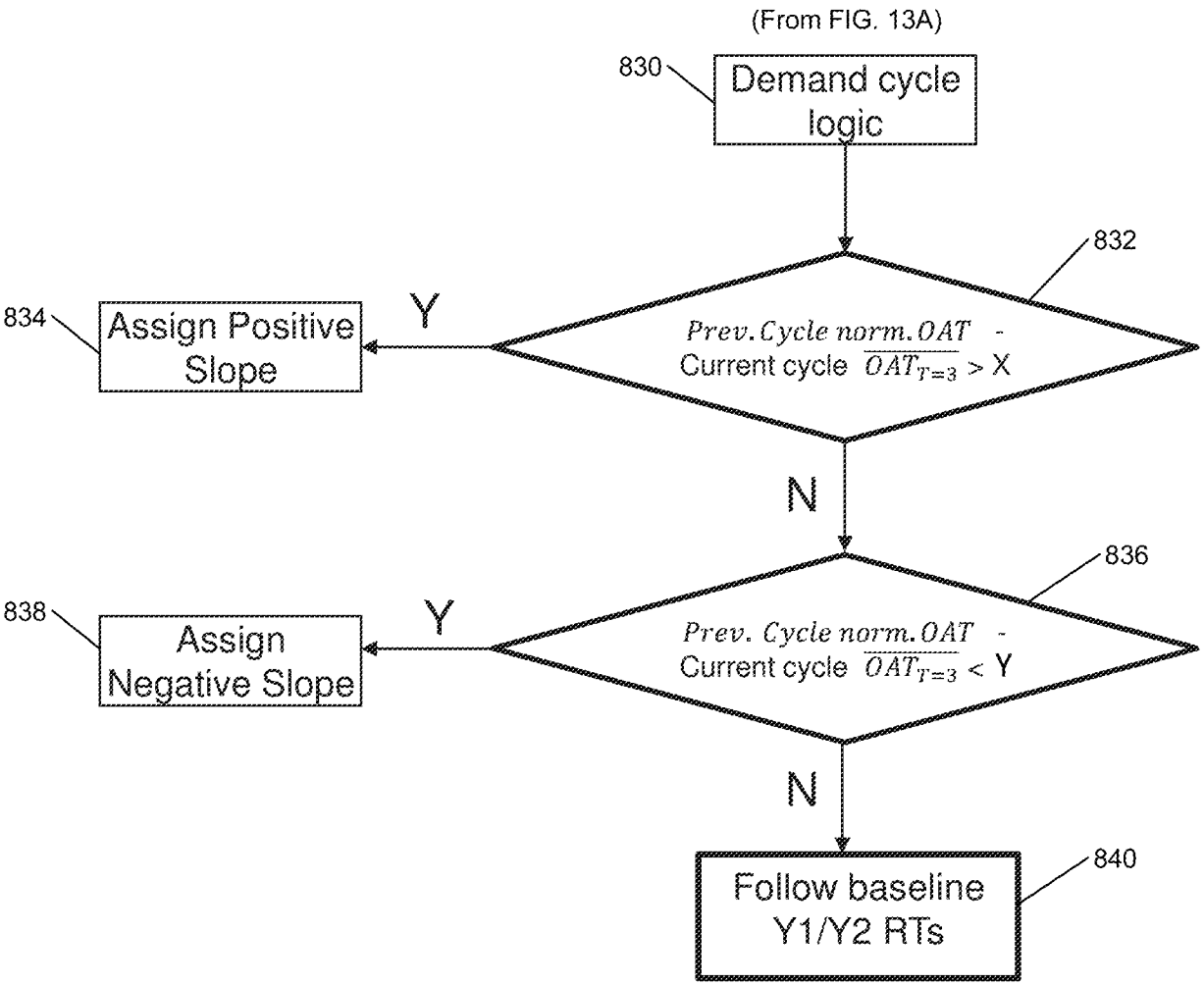

FIGS. 13A and 13B show a method 800 for determining OAT slope using a combination of the time based OAT slope determination method and the demand cycle based OAT slope determination method. At 802, control receives the demand signal from the thermostat 502. At 804, control operates the compressor 506 in the low capacity (Y1) mode. At 806, control starts a runtime counter that counts a predetermined time period (e.g., 3-5 minutes) for which the compressor 506 is operated in the Y1 stage. At 808, at the end of the predetermined time period, control determines a normalized value of the OAT and selects runtimes to operate the compressor 506 at the first and/or second capacity (i.e., Y1/Y2 runtimes) based on the normalized value of the OAT according to the baseline table shown in FIG. 8.

At 810, control determines whether the Y1 runtime (i.e., the runtime to operate the compressor at the low capacity (Y1) stage) has elapsed. At 812, if the Y1 runtime has elapsed, control switches the operating mode of the compressor 506 to Y2 (i.e., to the high-capacity mode). At 814, if the Y1 runtime has not elapsed, control determines whether the normalized OAT is greater than or equal to a predetermined value (e.g., 90 degrees) and the Y2 runtime of the compressor 506 in an immediately preceding demand cycle was greater than or equal to a predetermined duration.

Control returns to 812 if the normalized OAT is greater than or equal to the predetermined value (e.g., 90 degrees) and the Y2 runtime of the compressor 506 in the immediately preceding demand cycle was greater than or equal to the predetermined duration.

At 816, if the normalized OAT is not greater than or equal to the predetermined value (e.g., 90 degrees) or the Y2 runtime of the compressor 506 in the immediately preceding demand cycle was not greater than or equal to the predetermined duration, control determines whether the total duration (on time including Y1 and Y2 runtimes) of the immediately preceding demand cycle was greater than or equal to a predetermined value (e.g., 20 minutes).

At 818, if the total duration of the immediately preceding demand cycle was not greater than or equal to a predetermined value, control determines the OAT slope according to the time base method by first determining whether a difference between two normalized values of OAT in the present demand cycle is greater than a first predetermined threshold. For example, the two normalized values of OAT may be determined at the end of a first predetermined time period and at the end of a second predetermined time period counted from the beginning of the present demand cycle. For example, the two normalized values of OAT may be determined at the end of three minutes and at the end of six minutes counted from the beginning of the present demand cycle.

At 820, if the difference between the two normalized OAT values is greater than the first predetermined threshold, control assigns a positive value to the OAT slope, and control selects runtimes to operate the compressor 506 at the first and/or second capacity (i.e., Y1/Y2 runtimes) based on the OAT slope according to the extended table shown in FIG. 7.

At 822, if the difference between the two normalized values of OAT is not greater than the first predetermined threshold, control determines whether the difference between the two normalized values of OAT is less than a second predetermined threshold. At 824, if the difference between the two normalized OAT values is less than the second predetermined threshold, control assigns a negative value to the OAT slope, and control selects runtimes to operate the compressor 506 at the first and/or second capacity (i.e., Y1/Y2 runtimes) based on the OAT slope according to the extended table shown in FIG. 7.

At 826, if the difference between the two normalized OAT values is not less than the second predetermined threshold (and not greater than the first predetermined threshold), control selects runtimes to operate the compressor 506 at the first and/or second capacity (i.e., Y1/Y2 runtimes) according to the baseline table shown in FIG. 8.

At 830, if the total duration of the immediately preceding demand cycle was greater than or equal to a predetermined value, control determines the OAT according to the demand cycle based method. At 832, control determines whether a difference between a first normalized OAT value at the end of the predetermined time period (e.g., 3-5 minutes) from the beginning of the present demand cycle and a second normalized OAT at the end of an immediately preceding demand cycle is greater than a first predetermined threshold. At 834, if the difference between the first and second normalized OAT values is greater than the first predetermined threshold, control assigns a positive value to the OAT slope, and control selects runtimes to operate the compressor 506 at the first and/or second capacity (i.e., Y1/Y2 runtimes) based on the OAT slope according to the extended table shown in FIG. 7.

At 836, if the difference between the first and second normalized values of OAT is not greater than the first predetermined threshold, control determines whether the difference between the two normalized values of OAT is less than a second predetermined threshold. At 838, if the difference between the first and second normalized OAT values is less than the second predetermined threshold, control assigns a negative value to the OAT slope, and control selects runtimes to operate the compressor 506 at the first and/or second capacity (i.e., Y1/Y2 runtimes) based on the OAT according to the extended table shown in FIG. 7.

At 840, if the difference between the first and second normalized OAT values is not less than the second predetermined threshold (and not greater than the first predetermined threshold), control selects runtimes to operate the compressor 506 at the first and/or second capacity (i.e., Y1/Y2 runtimes) according to the baseline table shown in FIG. 8.

In FIGS. 11 and 13A-13B, using different threshold values for positive and negative slope determination provides sufficient window for detecting neutral slope. For example, suppose X=0.01 to 0.05, Y=0.01 to 0.05. If Slope>X, Detected Slope=Positive. If Slope<Y, Detected Slope=Negative. If Y<Slope<X, Detected Slope=Neutral.

In sum, the system 500 shown in FIG. 3 differs from a standard two-wire system in many respects. For example, in contrast to the standard two-wire system, the system 500 does not have access to the OAT data all the time since power is not supplied to the system 500 all the time. Consequently, the OAT data is either normalized after, for example, 3-5 minutes of runtime and then slope is determined, for example, at 6 minutes; or the normalized OAT data from a previous runtime is stored using the power received from the capacitor and then used with the new normalized OAT data determined at the 3-5 minute mark in the present runtime to calculate a new OAT slope for controlling the compressor.

Essentially, the controller 512 operates in different modes. For example, in a first mode, the controller 512 receives power from the demand signal during each demand cycle. In a second mode, the controller 512 receives power from the capacitor 514 for a predetermined time period after the thermostat 502 de-asserts the demand signal, and as a result, power is no longer available from the demand signal. The duration of the predetermined time period for which the capacitor 514 supplies power to the controller 512 after the thermostat 502 de-asserts the demand signal is much less than a time period between two consecutive demand cycles.

In some implementations, instead of determining the normalized OAT value after waiting for a preassigned time period (e.g., 3 minutes) from the beginning of a demand cycle, a normalized OAT value can be utilized after it reaches a steady value.

For example, during the preassigned time, the controller 512 may check if $$\frac{d(OAT)}{d(\text{Time})} > X$$

or <X, where X is a predetermined threshold. If $$\frac{d(OAT)}{d(\text{Time})} > X$$

or <X, the controller 512 continues to acquire the OAT data. Otherwise, the controller 512 assumes a steady state value of OAT and assigns Y1 and Y2 RT as per the steady state OAT value.

Accordingly, the controller 512 receives the OAT data when the demand signal is received, determines whether the OAT is in a steady state based on whether the slope of the data is greater or less than a predetermined threshold for a predetermined time period (e.g., 10-20 seconds), and if the OAT is in the steady state, selects a duration to operate the compressor 506 at the first capacity based on the steady state OAT value.

As used herein, indoor means a conditioned space, where the thermal load is for the house or unit (i.e., conditioned space) to be cooled or heated based on one or more outdoor conditions. Accordingly, outdoor thermal load means thermal load applied to the conditioned space.

The present disclosure describes a two-wire cooling system for example only. The teachings of the present disclosure apply equally to a two-wire heating system and to a two-wire heat pump system.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language) or XML (extensible markup language), (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective C, Haskell, Go, SQL, R, Lisp, Java®, Fortran, Perl, Pascal, Curl, OCaml, Javascript®, HTML5, Ada, ASP (active server pages), PHP, Scala, Eiffel, Smalltalk, Erlang, Ruby, Flash®, Visual Basic®, Lua, and Python®.

None of the elements recited in the claims are intended to be a means-plus-function element within the meaning of 35 U.S.C. § 112(f) unless an element is expressly recited using the phrase "means for," or in the case of a method claim using the phrases "operation for" or "step for."

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A climate control system comprising:

a converter to receive a demand signal from a thermostat and to generate power based on the demand signal; and a controller to receive the power generated by the converter based on the demand signal and to control a compressor based on the demand signal received from the thermostat and the power received from the converter, wherein the controller normalizes data obtained during a first predetermined time period in a demand cycle, the data indicating thermal load applied to a space conditioned by the compressor; selectively determines a slope of the data after a second predetermined time period in the demand cycle; and controls the compressor based on one or more of the normalized data and the slope of the data determined during the demand cycle.

2. The climate control system of claim 1 wherein the controller has access to the data during the demand cycle and for a third predetermined time period after the thermostat de-asserts the demand signal at an end of the demand cycle, the third predetermined time period being less than a time period between successive demand cycles; and wherein the controller receives power from the converter during the demand cycle and from a capacitor during the third predetermined time period, the capacitor being charged by the converter during the demand cycle.

3. The climate control system of claim 1 wherein the controller determines the slope of the data based on the normalized data from the demand cycle and based on an additional normalized data determined after the second predetermined time period in the demand cycle or determined in a prior demand cycle.

4. The climate control system of claim 3 further comprising:

a nonvolatile memory to store the normalized data from the demand cycle and the additional normalized data determined in the prior demand cycle; and a capacitor to receive power from the converter during each demand cycle and to supply the power to the nonvolatile memory at an end of each demand cycle.

5. The climate control system of claim 1 wherein the thermal load includes outdoor ambient temperature.

6. The climate control system of claim 1 further comprising a capacitor to receive the power from the converter and to supply the power from the capacitor to the controller after the thermostat de-asserts the demand signal, wherein the controller includes a nonvolatile memory, detects when the power from the converter is unavailable after the thermostat de-asserts the demand signal, receives the power from the capacitor after the thermostat de-asserts the demand signal, and stores one or more of the normalized data and the slope of the data in the nonvolatile memory based on the power received from the capacitor.

7. The climate control system of claim 6 wherein when the thermostat reasserts the demand signal, the controller reads the stored data from the nonvolatile memory and controls the compressor based on the read stored data.

8. The climate control system of claim 6 wherein after storing one or more of the normalized data and the slope of the data in the nonvolatile memory, the controller operates in a power save mode until the thermostat reasserts the demand signal.

9. The climate control system of claim 1 wherein the compressor is operable at a first capacity or a second capacity that is greater than the first capacity and wherein the controller operates the compressor at the first capacity for the first predetermined time period when the demand signal is received.

10. The climate control system of claim 9 wherein the controller receives, during the first predetermined time period, the data including measured values of a parameter indicating the thermal load, determines a normalized value of the parameter to generate the normalized data, and selects durations to operate the compressor at one or more of the first and second capacities based on the normalized value of the parameter.

11. The climate control system of claim 10 wherein the controller operates the compressor at the second capacity after operating the compressor at the first capacity for the selected duration.

12. The climate control system of claim 10 wherein the controller operates the compressor at the second capacity after the first predetermined time period and when the normalized value exceeds a threshold value and when a duration of operating the compressor at the second capacity in response to a prior demand signal exceeds a predefined duration.

13. The climate control system of claim 10 wherein before operating the compressor at the second capacity, the controller determines the slope of the data based on the normalized value of the parameter and an additional normalized value of the parameter determined based on additional measured values of the parameter received after the first predetermined time period, and selects the durations based on the slope of the data.

14. The climate control system of claim 9 wherein the controller receives, during the first and second predetermined time periods, the data including first and second measured values of a parameter indicating the thermal load, determines first and second normalized values of the parameter based on the first and second measured values and the first and second predetermined time periods, determines the slope of the data based on the first and second normalized values, and selects a duration to operate the compressor at the first capacity based on the slope of the data.

15. The climate control system of claim 9 wherein the controller receives the data including first values of a parameter indicating the thermal load when the demand signal is received, determines a first normalized value of the parameter from the first values, compares the first normalized value to a second normalized value of the parameter stored in the controller when a prior demand signal is de-asserted, determines the slope of the data based on the first and second normalized values, and determines durations to operate the compressor at one or more of the first and second capacities based on the slope of the data.

16. The climate control system of claim 9 wherein the controller receives the data including values of a parameter indicating the thermal load when the demand signal is received, determines whether the parameter is in a steady state based on the slope of the data for a third predetermined time period, and in response to the parameter being in the steady state, selects a duration to operate the compressor at the first capacity based on a value of the parameter in the steady state.

17. A method comprising:

receiving, at a converter, a demand signal from a thermostat;

generating, using the converter, power based on the demand signal received from the thermostat;

controlling, using a controller, a compressor based on the demand signal and the power generated based on the demand signal;

obtaining, at the controller, data during a first predetermined time period in a demand cycle, the data indicating thermal load applied to a space conditioned by the compressor;

selectively determining, using the controller, a slope of the data after a second predetermined time period in the demand cycle; and controlling, using the controller, the compressor based on one or more of a normalized value of the data and the slope of the data determined during the demand cycle.

18. The method of claim 17 wherein the thermal load includes outdoor ambient temperature.

19. The method of claim 17 further comprising:

charging, using the converter, a capacitor during the demand cycle;

supplying power to the controller from the converter during the demand cycle and from the capacitor during a third predetermined time period after the thermostat de-asserts the demand signal at an end of the demand cycle, the third predetermined time period being less than a time period between successive demand cycles; and accessing, using the controller, the data during the demand cycle based on the power received from the converter and during the third predetermined time period based on the power received from the capacitor.

20. The method of claim 17 further comprising determining, using the controller, the slope of the data based on the normalized data from the demand cycle and based on an additional normalized data determined after the second predetermined time period in the demand cycle or determined in a prior demand cycle.

21. The method of claim 19 further comprising:

storing, using the controller, the normalized data from the demand cycle and the additional normalized data determined in the prior demand cycle in a nonvolatile memory;

charging, using the converter, a capacitor based on the power generated based on the demand signal during each demand cycle; and supplying the power from the capacitor to the nonvolatile memory at the end of each demand cycle.

22. The method of claim 21 further comprising in response to the thermostat reasserting the demand signal, reading, using the controller, the stored data from the nonvolatile memory; and controlling, using the controller, the compressor based on the read stored data.

23. The method of claim 17 wherein the compressor is operable at a first capacity or a second capacity that is greater than the first capacity, the method further comprising operating, using the controller, the compressor at the first capacity for the first predetermined time period when the demand signal is received.

24. The method of claim 23 further comprising:

receiving, at the controller, during the first predetermined time period, the data including measured values of a parameter indicating the thermal load;

determining, using the controller, a normalized value of the parameter to generate the normalized value of the data; and selecting, using the controller, durations to operate the compressor at one or more of the first and second capacities based on the normalized value of the parameter.

25. The method of claim 24 further comprising operating, using the controller, the compressor at the second capacity after operating the compressor at the first capacity for the selected duration.

26. The method of claim 24 further comprising operating, using the controller, the compressor at the second capacity after the first predetermined time period and when the normalized value exceeds a threshold value and when a duration of operating the compressor at the second capacity in response to a prior demand signal exceeds a predefined duration.

27. The method of claim 24 further comprising before operating, using the controller, the compressor at the second capacity:

determining, using the controller, the slope of the data based on the normalized value of the parameter and an additional normalized value of the parameter determined based on additional measured values of the parameter received after the first predetermined time period; and selecting, using the controller, the durations based on the slope of the data.

28. The method of claim 23 further comprising:

receiving, at the controller, during the first and second predetermined time periods, the data including first and second measured values of a parameter indicating the thermal load;

determining, using the controller, first and second normalized values of the parameter based on the first and second measured values and the first and second predetermined time periods;

determining, using the controller, the slope of the data based on the first and second normalized values; and selecting, using the controller, a duration to operate the compressor at the first capacity based on the slope of the data.

29. The method of claim 23 further comprising:

receiving, at the controller, the data including first values of a parameter indicating the thermal load when the demand signal is received;

determining, using the controller, a first normalized value of the parameter based on the first values of the parameter;

comparing, using the controller, the first normalized value to a second normalized value of the parameter stored in the controller when a prior demand signal is de-asserted;

determining, using the controller, the slope of the data based on the first and second normalized values; and determining, using the controller, durations to operate the compressor at one or more of the first and second capacities based on the slope of the data.

30. The method of claim 23 further comprising:

receiving, at the controller, the data including values of a parameter indicating the thermal load when the demand signal is received;

determining, using the controller, whether the parameter is in a steady state based on the slope of the data for a third predetermined time period; and in response to the parameter being in the steady state, selecting, using the controller, a duration to operate the compressor at the first capacity based on a value of the parameter in the steady state.

* * * * *